US006990843B2

(12) United States Patent
Frenken

(10) Patent No.: US 6,990,843 B2
(45) Date of Patent: Jan. 31, 2006

(54) PRESSING TOOL

(75) Inventor: Egbert Frenken, Wermelskirchen (DE)

(73) Assignee: Gustav Klauke GmbH, (DE)

( * ) Notice: Subject to any disclaimer, the term of this patent is extended or adjusted under 35 U.S.C. 154(b) by 112 days.

(21) Appl. No.: 10/250,352

(22) PCT Filed: Dec. 1, 2001

(86) PCT No.: PCT/EP01/14063

§ 371 (c)(1),
(2), (4) Date: Nov. 13, 2003

(87) PCT Pub. No.: WO02/054542

PCT Pub. Date: Jul. 11, 2002

(65) Prior Publication Data

US 2004/0079132 A1 Apr. 29, 2004

(30) Foreign Application Priority Data

Jan. 5, 2001 (DE) ..... 101 00 398

(51) Int. Cl.
*H01R 43/042* (2006.01)
*B21D 39/04* (2006.01)

(52) U.S. Cl. ..... 72/402; 72/416; 29/751

(58) Field of Classification Search ..... 72/402, 72/394, 396, 416; 29/751, 753
See application file for complete search history.

(56) References Cited

U.S. PATENT DOCUMENTS

| | | | | |
|---|---|---|---|---|
| 3,695,087 | A * | 10/1972 | Tuberman | 72/402 |
| 3,728,889 | A * | 4/1973 | McIver et al. | 72/402 |
| 4,308,744 | A * | 1/1982 | Baker | 72/402 |
| 5,335,530 | A | 8/1994 | Homm | |
| 5,934,136 | A | 8/1999 | Bracher et al. | |

FOREIGN PATENT DOCUMENTS

| | | |
|---|---|---|
| DE | 19520928 | 12/1996 |

* cited by examiner

*Primary Examiner*—Daniel C. Crane
(74) *Attorney, Agent, or Firm*—Trexler, Bushnell, Giangiorgi, Blackstone & Marr, Ltd.

(57) ABSTRACT

The invention relates to a pressing tool (8) provided with three or four press mandrels (12, 15) which move towards each other during the pressing process. The press mandrels (12–15) have a roof-shaped transversal profile. The lateral distance (36) between the press mandrels (12–15) is increasingly reduced during the pressing process. An extending element (37) is arranged between two press mandrels, extending from one press mandrel to another press mandrel and being inserted into the other press mandrel during the pressing process. The aim of the invention is to improve said pressing device and to improve pressing. In order to block the above-mentioned distance (36), the extending element (37) is disposed in such a way that both roof edges (38) of the corresponding press mandrels cut across said extending element (37) in an initial position.

17 Claims, 20 Drawing Sheets

1
2
3
5
6
7
8
9
10
32
33
35 y
17
13
23
25
12
8
10
44
42
36
37
48
x
19
15
34
49
44
42
37
9
x
16
25
18
14
36
23 y
44
13
42
37
12
8
10
37
36
XXVII
XXVII
48
x
15
37
42
34
36
49
44
14
37
36
x
9

PRESSING TOOL

This application claims priority with respect to German Application No. 10100398.6, filed Jan. 5, 2001, and PCT Application No. PCT/EP01/14063, filed Dec. 1, 2001.

The invention relates, in the first instance, to a pressing tool with three or four pressing mandrels which can be moved towards one another during a pressing process, it being the case that the pressing mandrels have a roof-like cross-sectional profile, and that, furthermore, a lateral clearance space between the pressing mandrels is increasingly reduced during a pressing process, and disposed between two pressing mandrels is an extension element which extends from one pressing mandrel to the other and moves into the other pressing mandrel during pressing.

Such pressing tools are known and serve, inter alia, for connecting a cable end to a cable eye, two or three of the pressing mandrels being displaced, by means of hydraulic actuation, in the direction of the centre of the pressing space during the pressing process. In this respect, for example, a four-mandrel pressing tool is known from Canadian patent 679 495 which has a fixed pressing mandrel and three further pressing mandrels which can be displaced to the centre of a pressing space, in each case one extension element being disposed in the region of the lateral clearance spaces between the displaceable pressing mandrels, for the purpose of guiding the pressing jaws carrying the pressing mandrels. The problem with the known pressing tools is that, between being placed in position and actually being pressed, the blank, for example the cable eye accommodating a cable end, changes its position to the extent where unsuccessful pressing is achieved.

In respect of the abovedescribed prior art, it is a problem of the invention for a pressing tool of the type in question to be developed in an advantageous manner in particular in respect of an improved pressing result.

This problem is solved first and foremost by the subject matter of claim 1, this being based on the fact that the extension element, for the purpose of blocking the clearance space, is arranged such that, in the initial state, the two roof edges of the associated pressing mandrels cut across the extension element. As a result of this configuration according to the invention, the blank which is to be placed in position and pressed is supported at such a level that, as the pressing mandrels are moved towards it, self-centring of the blank between these mandrels is achieved. The pressing sleeve of a cable eye is thus always located entirely in the region of action of the pressing mandrels, so that precise, successful pressing of the cable eye and cable end is always achieved. The extension element here is positioned such that a blank which is not positioned centrally in the pressing space is always forced into the desired pressing position by the extension element during the pressing process. In this case, an extension element is disposed between two pressing mandrels such that the respectively facing edge of the pressing mandrel, at least in prolongation of the same, cuts across the extension element. Furthermore, the arrangement of the extension element is selected such that the blank which is to be pressed, in an original arrangement in the region of the lateral clearance space between two pressing mandrels, encloses an angle, between a perpendicular to the direction in which the blank is advanced out of the clearance space and a bearing point on an oblique surface of a pressing mandrel, which is larger than the angle of friction, this achieving the desired advancement of the eccentrically positioned blank between the pressing mandrels during pressing. In a preferred configuration, extension elements disposed according to the invention pass through two of the three lateral clearance spaces, in a pressing tool with three mandrels, and through three of the four clearance spaces, in the case of a pressing tool with four pressing mandrels.

It may also be provided that the fixed pressing mandrel is fastened on a pivoting bracket, by means of which the radial access to the pressing space can be blocked. Following placement and closure of the pivoting bracket, the latter is preferably locked in a positive manner. In order to achieve an improved pressing result, in the case of a four-mandrel pressing tool of the type in question, it being the case that the pressing mandrels have a roof-like cross-sectional profile, and that, furthermore, a lateral clearance space between the pressing mandrels is increasingly reduced during a pressing process, and disposed between two pressing mandrels is an extension element which extends from one pressing mandrel to the other and moves into the other pressing mandrel during pressing, it is proposed that the extension element, for the purpose of blocking the clearance space, is disposed such that, in the initial state, the two roof edges of the associated pressing mandrels cut across the extension element. As a result of this configuration according to the invention, the blank which is to be placed in position and pressed is supported at such a level that, as the pressing mandrels are moved towards it, self-centring of the blank between these mandrels is achieved. The pressing sleeve of a cable eye is thus always located entirely in the region of action of the pressing mandrels, so that precise, successful pressing of the cable eye and cable end is always achieved. The extension element here is positioned such that a blank which is not positioned centrally in the pressing space is always forced into the desired pressing position by the extension element during the pressing process. In this case, an extension element is disposed between two pressing mandrels such that the respectively facing edge of the pressing mandrel, at least in prolongation of the same, cuts across the extension element. Furthermore, the arrangement of the extension element is selected such that the blank which is to be pressed, in an original arrangement in the region of the lateral clearance space between two pressing mandrels, encloses an angle, between a perpendicular to the direction in which the blank is advanced out of the clearance space and a bearing point on an oblique surface of a pressing mandrel, which is larger than the angle of friction, this achieving the desired advancement of the eccentrically positioned blank between the pressing mandrels during pressing. Disposing the fixed pressing mandrel on a pivoting bracket which releases the pressing space advantageously makes it possible for two extension elements projecting in opposite directions to be fitted on the fixed pressing mandrel. As a result of this configuration, in the closed state of the pivoting bracket, that is to say with the pressing space closed, extension elements disposed according to the invention pass through all the clearance spaces produced between the four pressing mandrels. Irrespective of whether a pressing tool with a radial pressing-space opening or a four-mandrel tool with a fixed pressing mandrel fastened on a pivoting bracket is present, it is further proposed that an edge of the extension element which is directed towards the pressing space, on the two associated pressing mandrels, runs directly beneath the roof edge. As a result of this arrangement, at least in the initial state, and preferably also over much of the displacement path of the pressing mandrels, trapezoidal surfaces are defined in the region of the clearance space, the top lines of these surfaces connecting the roof ridges of two adjacent pressing mandrels and the bottom lines thereof being formed by that edge of the extension element which is directed towards the pressing space. The side lines of the trapezoidal surfaces are substantially formed by the two roof edges of the associated pressing mandrels, the length of the trapezium side lines corresponding to the length of a roof edge. As an alternative, it is also possible for the length of this trapezium side line to correspond to 1.1 to 1.3 times the roof-edge length. The significant factor here is for the trapezium side line to be smaller than 1.5 times the roof-edge length. In an exemplary configuration of the subject matter of the invention, it may be provided that an extension element is formed integrally with one pressing mandrel and moves into a corresponding recess of the other pressing mandrel. The extension element may thus be formed as a supplementary supporting surface of the pressing mandrel, in which case the supplementary supporting surfaces of two adjacent pressing mandrels overlap as they are moved together and, in the extended state, that is to say in the initial state, close the clearance space between the two adjacent pressing mandrels at least to the extent where a cable eye of conventional diameter cannot pass through. In this respect, it is further proposed that an edge of the extension element which is directed towards the pressing space runs into the eaves of the roof of the pressing mandrel, this edge of the extension element also being inclined preferably approximately to the same extent as the remote roof edge of the associated pressing mandrel. Furthermore, it is preferably provided that the extent of the integrally formed extension element is less than the width of the roof. A preferred configuration is one in which the extent of the integrally formed extension element is less than half the width of the roof. It is advantageously further provided that two adjacent pressing mandrels each have an integrally formed extension element, the extension elements alternately projecting towards one another. In this case, each extension element is assigned, laterally adjacent to it, a recess for the introduction of the extension element of the adjacent pressing mandrel. As a result of this configuration, it is ensured that the extension elements, which shift the blank, for example the cable eye, into the correct position, do not enter into the pressing space. Accordingly, only the pressing mandrels with the roof-like cross-sectional profile are active during pressing. It is also provided that the associated extension elements are offset depthwise in relation to one another. As an alternative to the pressing mandrel and extension element being formed in one piece, it may also be provided that an extension element is formed by a rod-like element which is anchored in one pressing mandrel and is accommodated in a freely movable manner in the other pressing mandrel. For this purpose, the other, adjacent pressing mandrel has, for example, a bore into which the extension element can penetrate during the pressing operation and the accompanying displacement of the pressing mandrels and/or of the pressing jaws carrying the latter. In this respect, it is further provided that the extension element is a round rod, which may furthermore also be in the form of a needle. In addition, it is provided that two rod-like extension elements are offset in relation to one another. These are thus, further preferably, offset depthwise in relation to one another, so that the extension elements act in adjacent planes. As a further alternative, it may be provided that the extension element is attached to a side surface of the pressing mandrel, and/or of the pressing jaw carrying the pressing mandrel, and moves past the side surface of the adjacent pressing mandrel during pressing. It is thus further preferably provided that two oppositely located extension elements are fastened on a pressing mandrel. These extension elements attached on both sides of the pressing mandrel are advantageously formed symmetrically here, it being possible for an extension element to be in the form of a sheet-metal angle element. As an alternative the extension element may also be in the form of a bent wire part.

The invention is explained in more detail hereinbelow with reference to accompanying drawings, which merely illustrate a number of exemplary embodiments and in which:

FIG. 7 shows an illustration corresponding to FIG. 4, but relating to the pressing position;

Figures 1, 2:
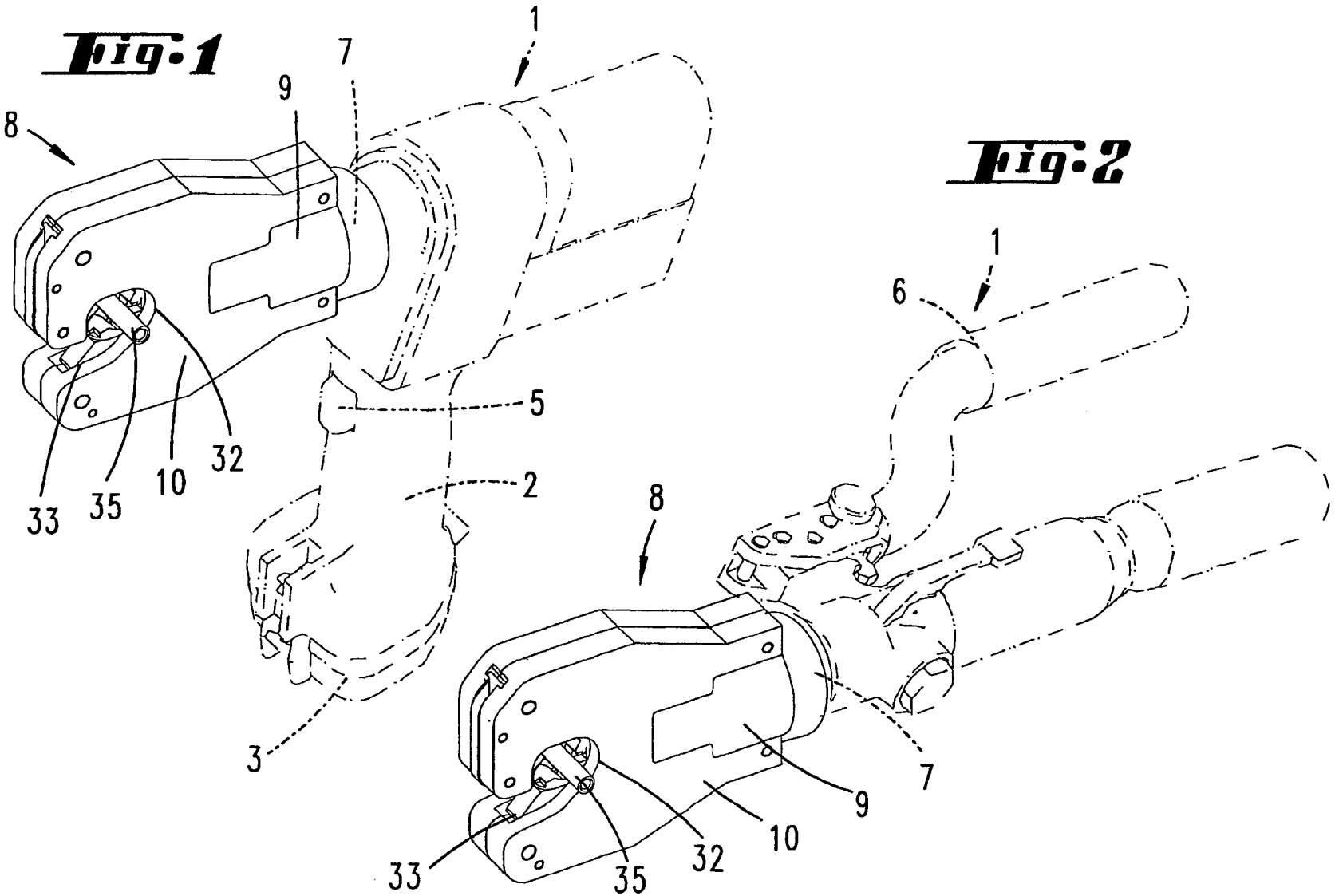
FIG. 1 shows, in a perspective illustration, a hydraulic implement which is operated by an electric motor and has an associated pressing tool according to the invention.
FIG. 2 shows a further perspective illustration of a hydraulic implement in the form of a manually operated implement with a pressing tool according to the invention.

A hydraulic implement 1 in the form of a pressing implement, which is operated by an electric motor, will be illustrated and described in the first instance with reference to FIG. 1. Such a pressing implement is known from German Patent Application 198 25 160.2. Reference is also made to German Patent Application 197 43 747. The content of these patent applications are hereby included in full in the disclosure of the present invention, also for the purpose of including features of these patent applications in claims of the present invention.

An electric motor is disposed in the implement 1. This electric motor is driven via a storage battery 3 integrated in a handgrip 2. Actuation of a finger-actuable switch 5 causes oil to be pumped from a supply container into a pressure space, as a result of which a hydraulic cylinder is moved, counter to the action of a restoring spring, in the direction of its operating end position.

The hydraulic cylinder is moved back via a restoring spring as soon as a non-return value opens on account of a predetermined maximum pressure being exceeded.

The implement illustrated in FIG. 2 is in the form of a manually actuable implement. Accordingly, the pressure required for displacing the hydraulic cylinder is built up by manual actuation, via a pumping lever 6, rather than by an electric motor.

Irrespective of the formation of the implement 1, the latter has a neck 7 which encloses the hydraulic cylinder (not illustrated specifically) and on which a pressing tool 8 can be disposed. The arrangement of the securing head 9 of the pressing tool 8 on the neck 7 is preferably chosen such that the securing head 9, and thus the pressing tool 8, can be rotated about the neck axis.

Figure 10:
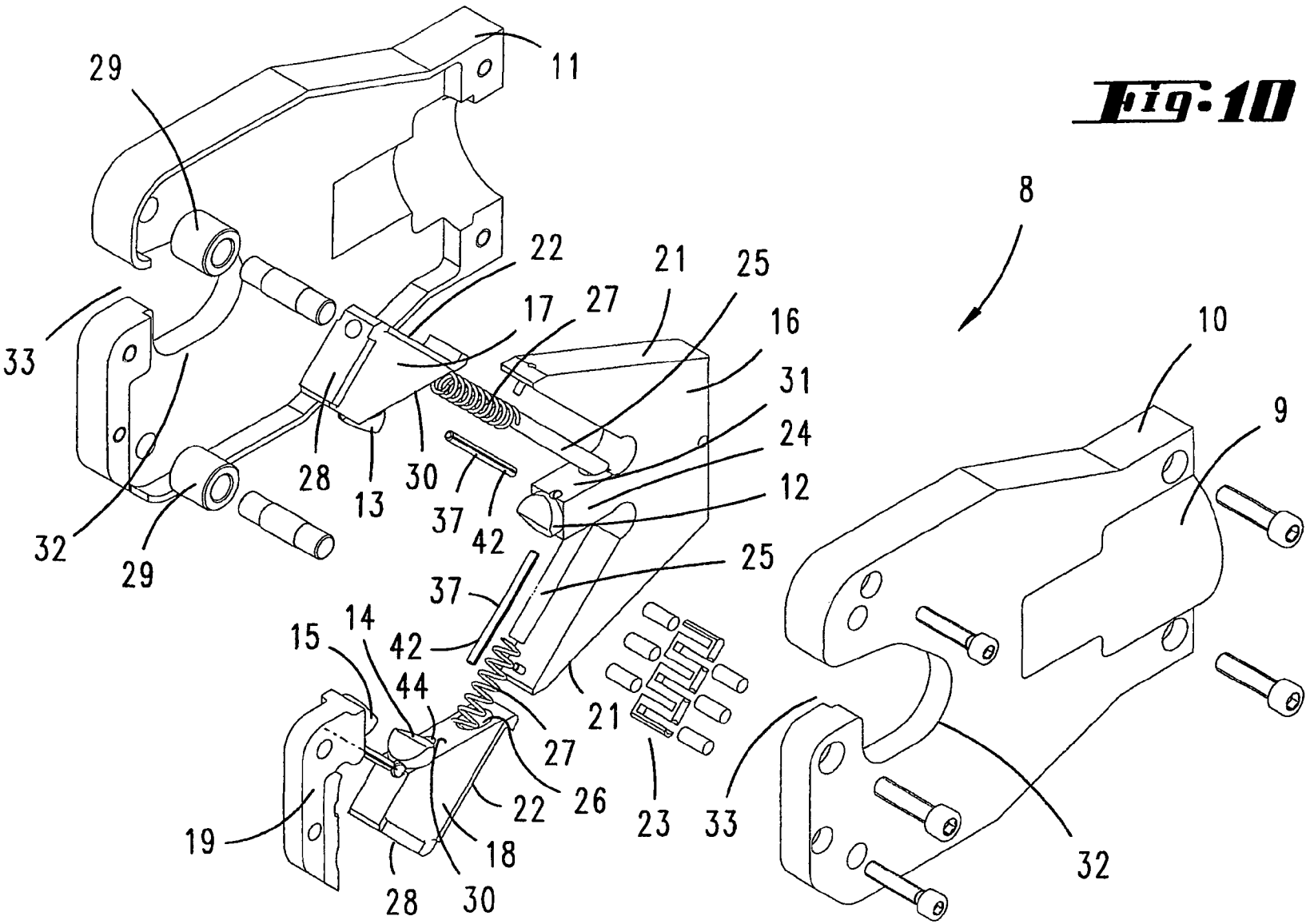
FIG. 10 shows a perspective exploded illustration of the pressing tool according to the second embodiment.
Figure 11:
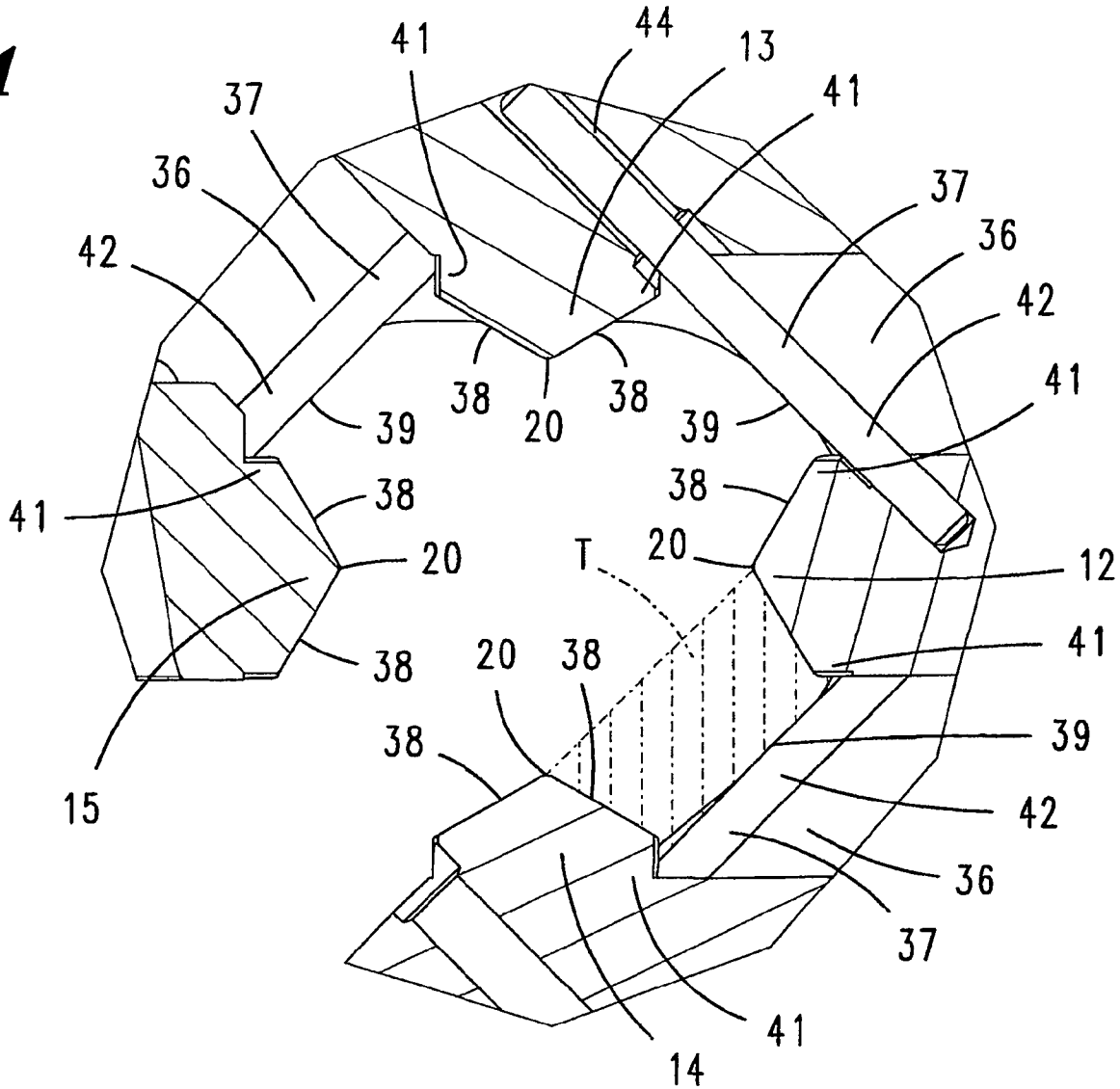
FIG. 11 shows the enlargement of the region XI—XI in FIG. 9.
Figure 12:
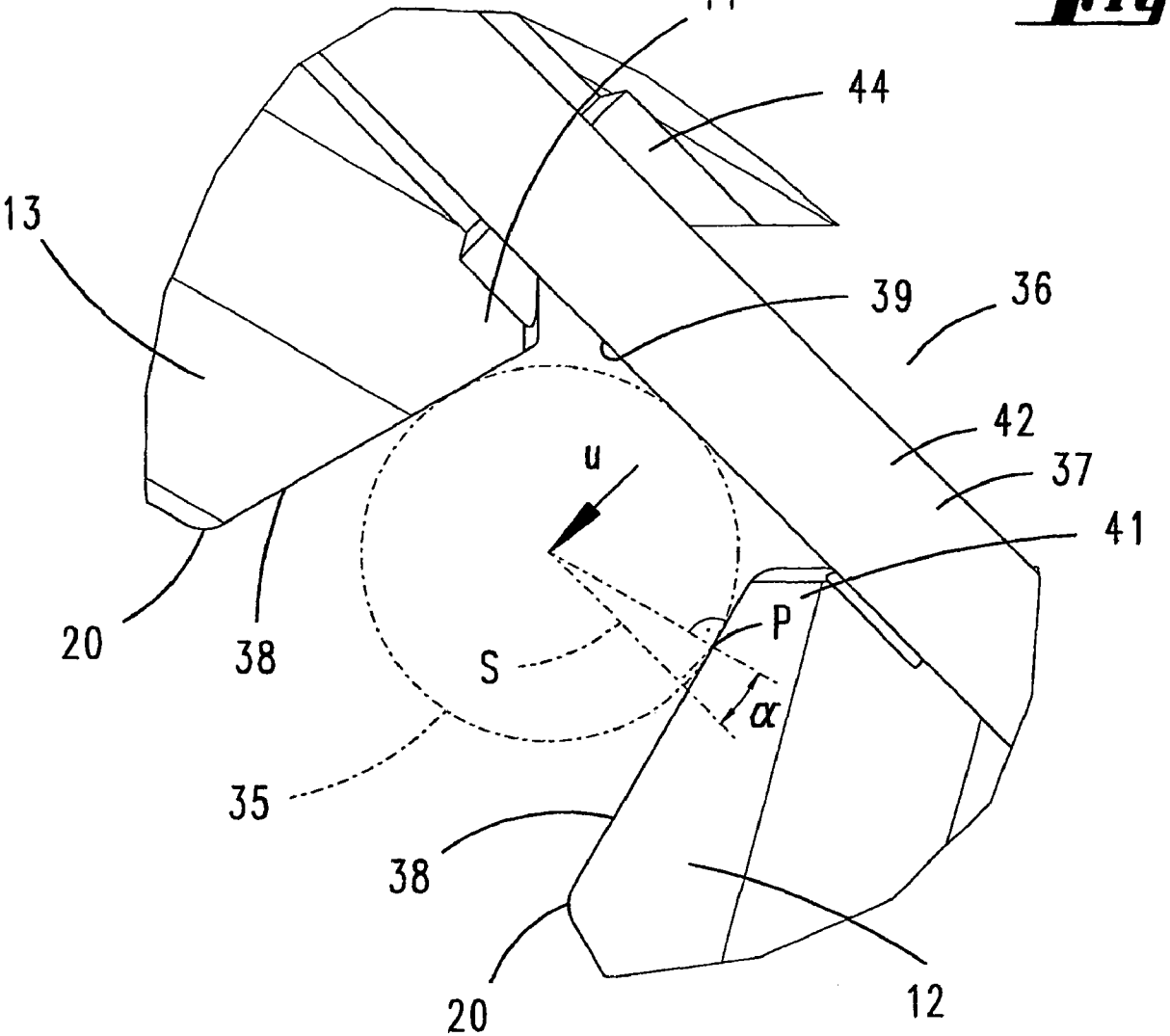
FIG. 12 shows a further enlargement, but this time relating to an intermediate position of the pressing mandrels of the pressing tool during the pressing operation.
Figure 13:
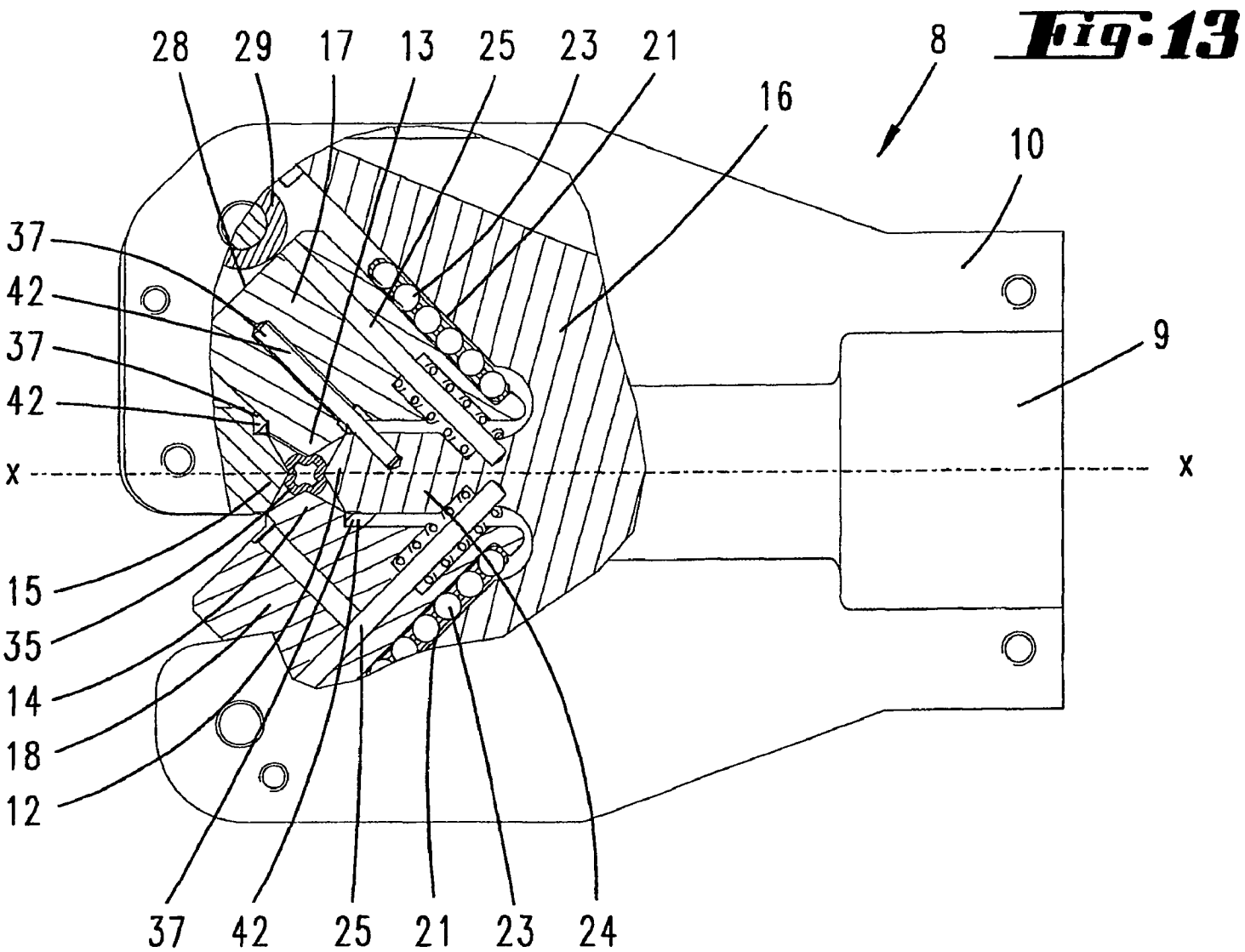
FIG. 13 shows an illustration corresponding to FIG. 9, but relating to the pressing position.

Irrespective of the embodiments described hereinbelow, the pressing tool 8 substantially comprises two shell-like housing parts 10, 11 which, screw-connected to one another, leave an accommodating space between them for the purpose of accommodating four pressing jaws 16 to 19 each provided with a pressing mandrel 12 to 15 (see, in this respect, for example the illustration in FIG. 10).

In a known manner here, the pressing jaw 16 is mounted for sliding action in the housing along the longitudinal extent of the pressing tool 8 and has the hydraulic piston of the implement 1 acting on it from the rear during the pressing operation.

Opposite the surface on which the hydraulic piston acts, the associated pressing mandrel 12 is formed on the pressing jaw 16, disposed on the hydraulic-piston axis in the operating position. This pressing mandrel, just like the further pressing mandrels 13 to 15 which are yet to be described, has a circular outline in plan view with a roof-like cross-sectional profile, the roof ridge 20 being oriented transversely to the displacement direction of the pressing jaw.

Above and beneath the pressing mandrel 12, the pressing jaw 16 is provided with wedge-shaped notches, the wedge surfaces 21, which are directed away from the pressing mandrel 12, interacting with correspondingly oriented wedge surfaces 22 of the pressing jaws 17 and 18. Rolling-contact bearings 23 are disposed between the wedge surfaces 21 and 22.

Furthermore, in the region of the continuation 24 formed by the cutouts, and carrying the pressing mandrel 12, guide pins 25 which extend parallel to the wedge surfaces 21 are anchored on both sides, the other ends of these guide pins penetrating into correspondingly oriented bores 26 of the pressing jaws 17 and 18. Positioned between the pressing jaws 17, 18 and the continuation 24 of the pressing jaw 16 in each case is a compression spring 27, which surrounds the associated guide pin 25.

On the side which is directed away from the continuation 24 of the pressing jaw 16, furthermore, the pressing jaws 17, 18 have a control surface 28, which runs at right angles to their wedge surface 22 and, assisted by the compression spring 27, engages against a guide roller 29 which is mounted in a rotatable manner on the housing.

Figure 3:
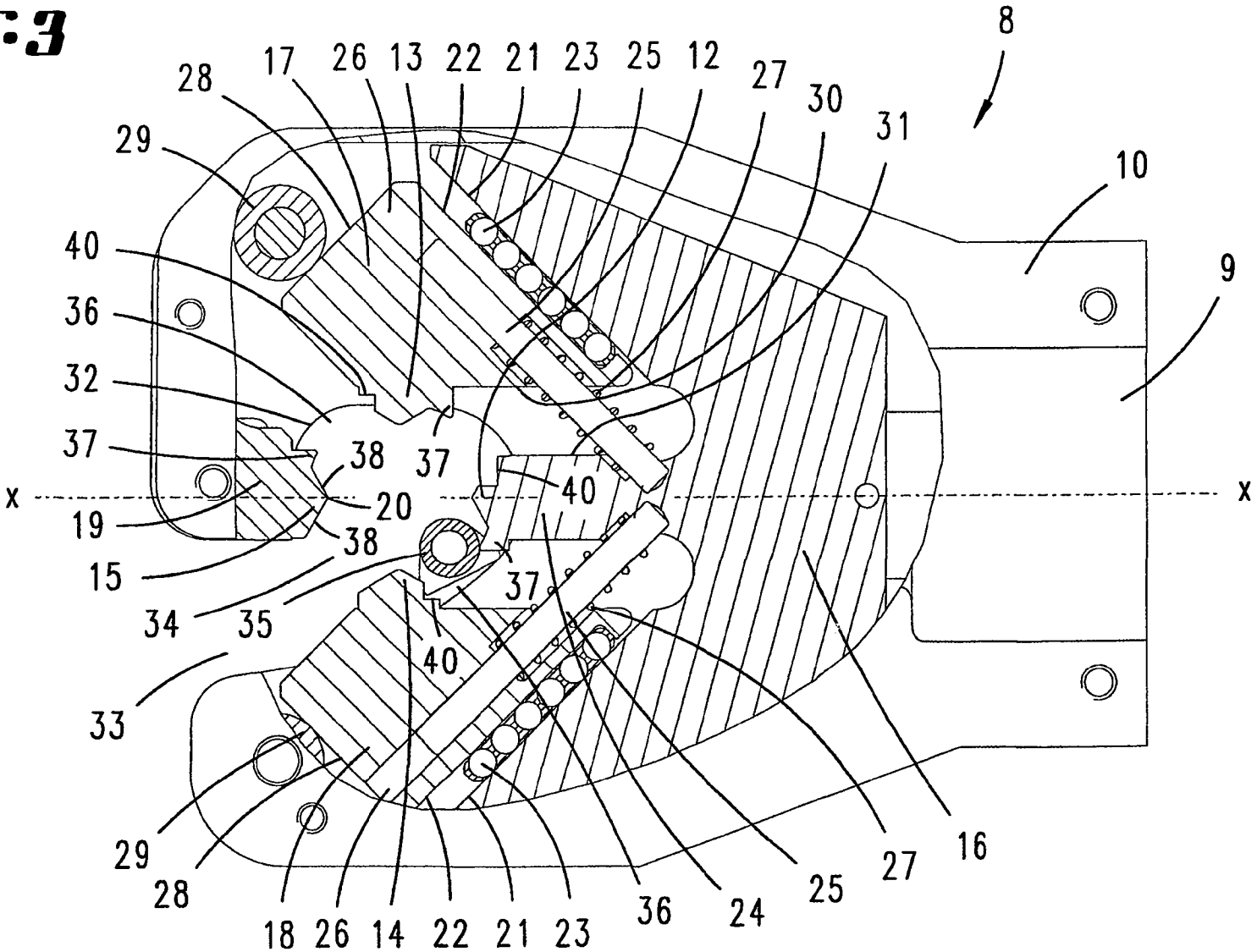
FIG. 3 shows a partially longitudinally sectioned pressing tool in the initial state, relating to a first embodiment.
Figure 4:
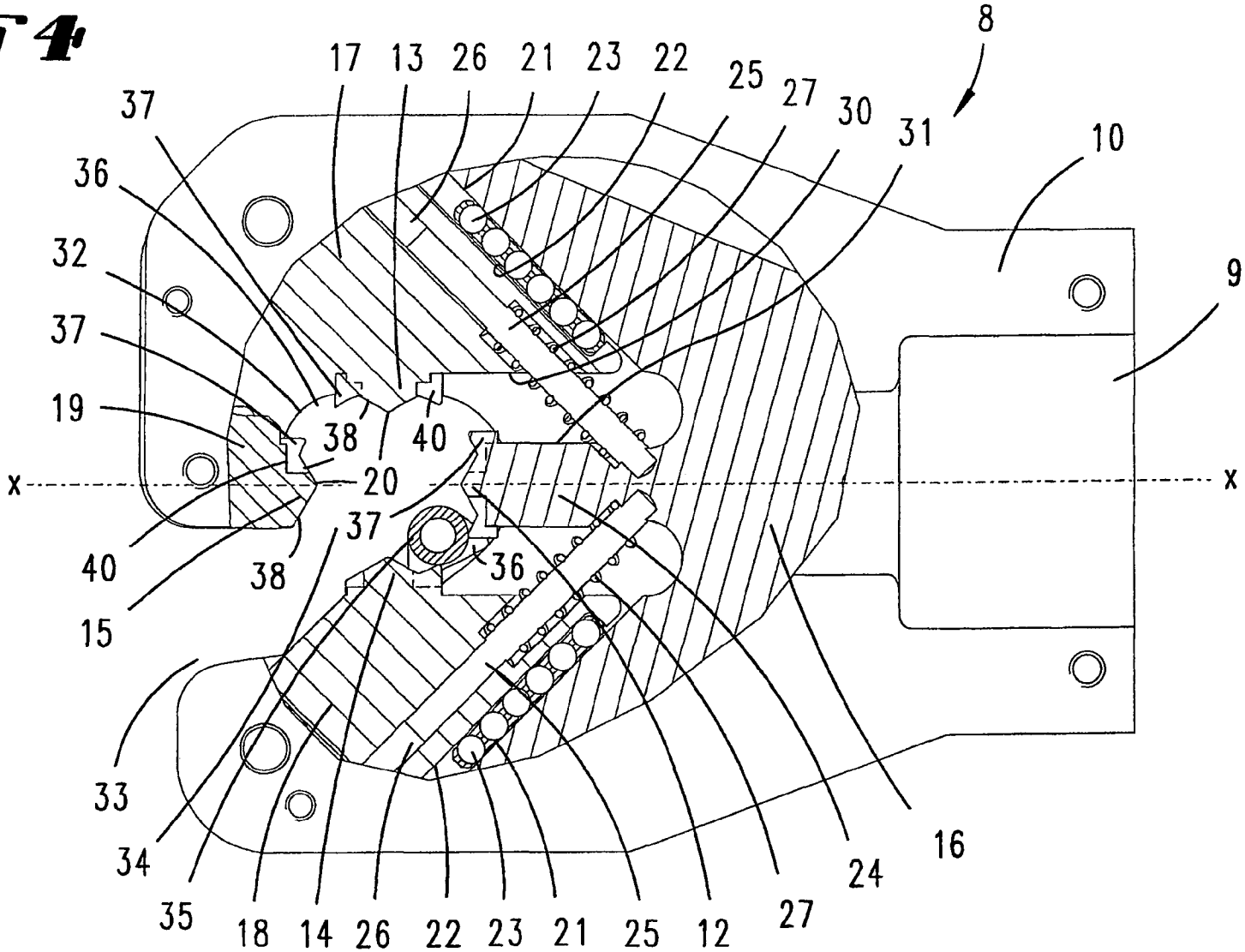
FIG. 4 shows a sectional illustration corresponding to FIG. 3, but in a section through a plane adjacent to FIG. 3.
Figure 5:
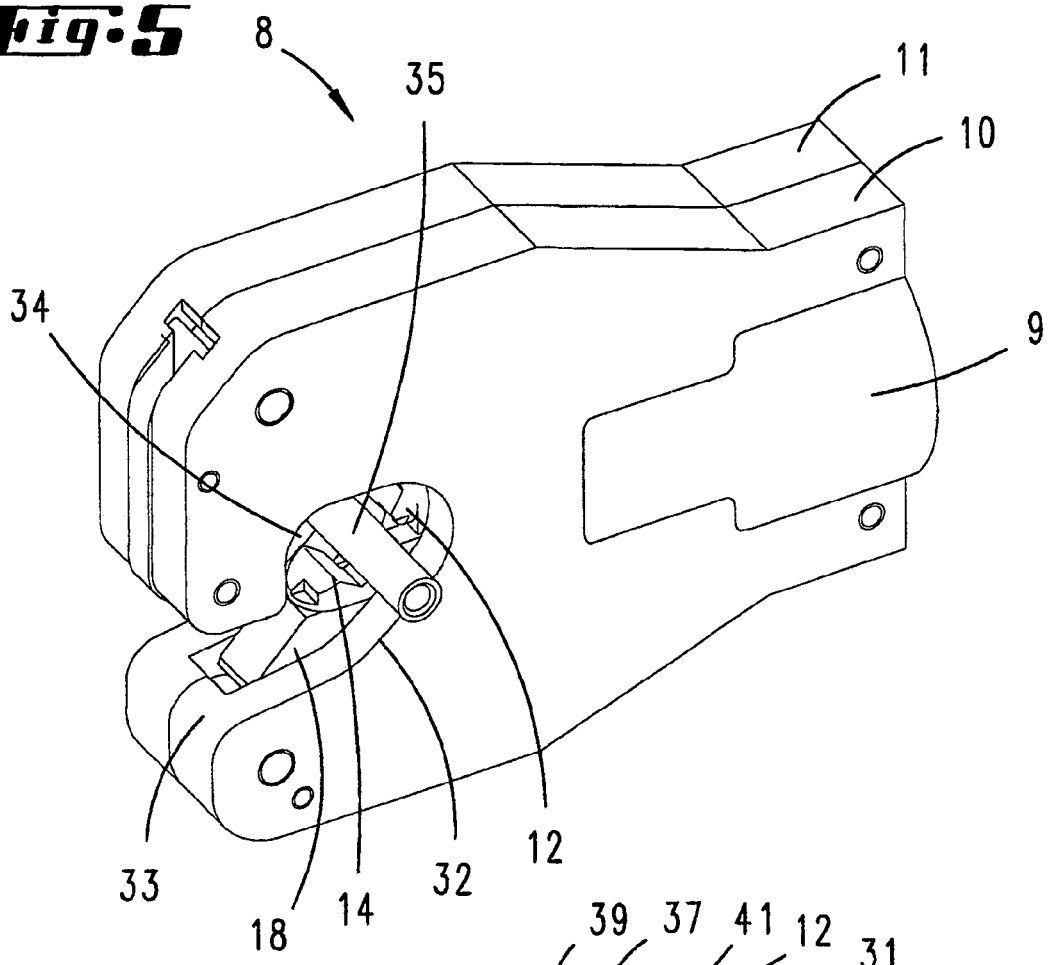
FIG. 5 shows the pressing tool of the first embodiment in a perspective illustration on its own.

The mutually facing surfaces 30, 31 of the pressing jaws 17, 18 and of the continuation 24—in relation to a longitudinally sectioned illustration according to FIG. 3—are oriented parallel to a displacement axis x which runs in extension of the hydraulic-piston axis.

The pressing mandrels 13, 14 are oriented towards one another, at right angles to the pressing mandrel 12, on the surfaces 30 of the pressing jaws 17, 18.

The fourth pressing jaw 19 is anchored in the housing, and is thus fixed, the pressing mandrel 15 thereof, oriented along the axis x, facing in the direction of the opposite pressing mandrel 12 of the displaceable pressing jaw 16.

In the initial state of the pressing tool 8, the pressing mandrels 12 to 15 are spaced apart uniformly from one another. The pressing space 34 described here is open on both sides by way of corresponding recesses 32 in the housing parts 10, 11. These recesses 32 are open radially outwards in the direction of an end side of the pressing tool 8, an introduction channel 33 being formed as a result. Starting from the end side of the pressing tool 8, this introduction channel substantially extends between the fixed pressing mandrel 15 and a pressing mandrel 14 disposed perpendicularly thereto. As a result of this configuration, it is possible for a cable end which is to be pressed, for example, with a cable eye to be introduced through the introduction channel 33 into the pressing space 34 bounded by the pressing mandrels 12 to 15.

During a pressing operation, in the case of which the hydraulic piston of the implement 1 engages against the rear of the pressing jaw 16, this pressing jaw 16 with the pressing mandrel 12 is displaced, along the pressing axis x, in the direction of the fixed pressing mandrel 15 located opposite, which at the same time, via the wedge surfaces 21 and 22—with the roller-contact bearings provided therebetween—and via the control surface 28 supported on the guide roller 29, causes the pressing jaws 17 and 18 to be displaced. This displacement of the pressing jaws 17, 18 takes place both parallel to the displacement of the pressing jaw 16 and, at the same time, in the perpendicular direction, so that the three movable pressing mandrels 12 to 14 move uniformly in the direction of the fixed pressing mandrel 15, with the blank, for example cable eye 35, which is positioned in the pressing space 34 being pressed uniformly in the process.

Once pressing has taken place, that is to say once a predetermined pressing pressure has been exceeded, the hydraulic piston, as has been described, moves back automatically into the starting position. The pressing jaws follow the hydraulic piston on account of the compression springs 27, which are compressed during pressing, being relieved of stressing, the pressing jaws 17, 18 being carried along via the guide pins 25 anchored in the pressing jaw 16.

In order for the cable eye 35 which is to be pressed, and is positioned in the pressing space 34, to be prevented from sliding into the lateral clearance spaces 36 which are located between the pressing mandrels and are increasingly reduced during the pressing operation—which sliding action could possibly result in unsuccessful pressing—various solutions are presented by the embodiments which are described in more detail hereinbelow.

Common to all the embodiments illustrated is the fact that two pressing mandrels 12 and 13, 12 and 14 and also 13 and 15 have disposed between them in each case an extension element 37 which extends from one pressing mandrel to the other, the extension element 37 being anchored on one pressing mandrel and moving into the other pressing mandrel during pressing. According to the invention, the extension elements 37, for the purpose of blocking the clearance space 36, are disposed such that, both in the initial state and during the pressing operation, the two associated roof edges 38 of the pressing mandrels bounding the clearance space 36 cut across the extension element 37, it being the case, furthermore, that the edge 39 of the extension element 37 which is directed towards the pressing space 34, on the two associated pressing mandrels, runs directly beneath the roof edge 38. This results in the formation of a trapezoidal surface T which is bounded by the facing edges 38 of the associated pressing mandrels and that edge of the extension element 37 which is directed towards the pressing space 34 and also by an imaginary line connecting the roof ridges 20 of the associated pressing mandrels, the side boundary lines of the trapezoidal surface corresponding to 1 to 1.3 times the roof-edge length. As a result of this configuration, the blank, for example the cable eye 35, is always forced in the direction of the pressing space 34 during the pressing operation, that is to say during the advancement of the pressing mandrels 12 to 14 in the direction of the pressing mandrel 15, so that the blank is present in the correct position between the pressing mandrels 12 to 15 during pressing.

In the first exemplary embodiment, which is illustrated in FIGS. 3 to 7, the extension element 37 is formed integrally with a pressing mandrel 12 to 15, in order to form a supplementary supporting surface. Each pressing mandrel 12 to 15 has a protrusion-like extension element 37 in each case assigned to each roof edge 38, the two extension elements 37 of a pressing mandrel being disposed in offset planes in the direction in which the roof ridge 20 extends. Recesses 40 are provided on one side adjacent to these extension elements 37, extension elements 37 of the adjacent pressing mandrels moving into these recesses during the pressing operation, and the extension elements 37 of two adjacent pressing mandrels projecting alternately towards one another in each case.

Figure 6:
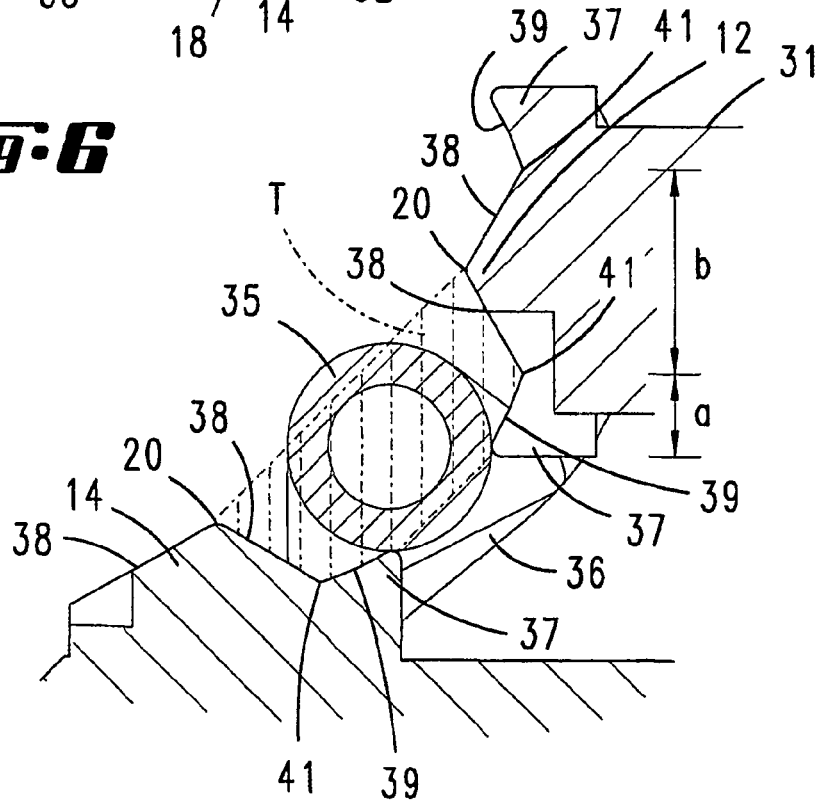
FIG. 6 shows the enlargement of the region VI—VI in FIG. 4.
Figure 1:
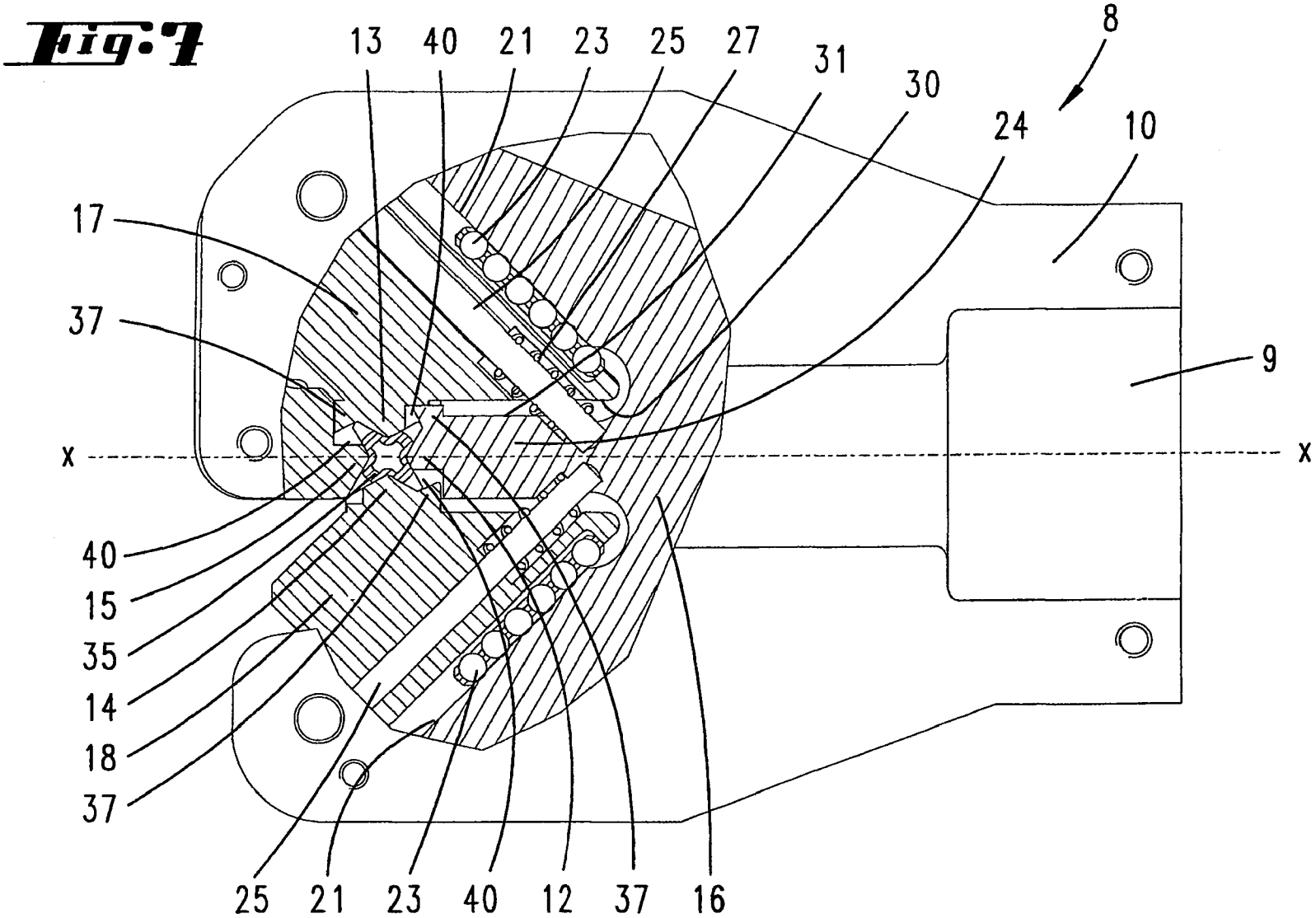
Figure 8:
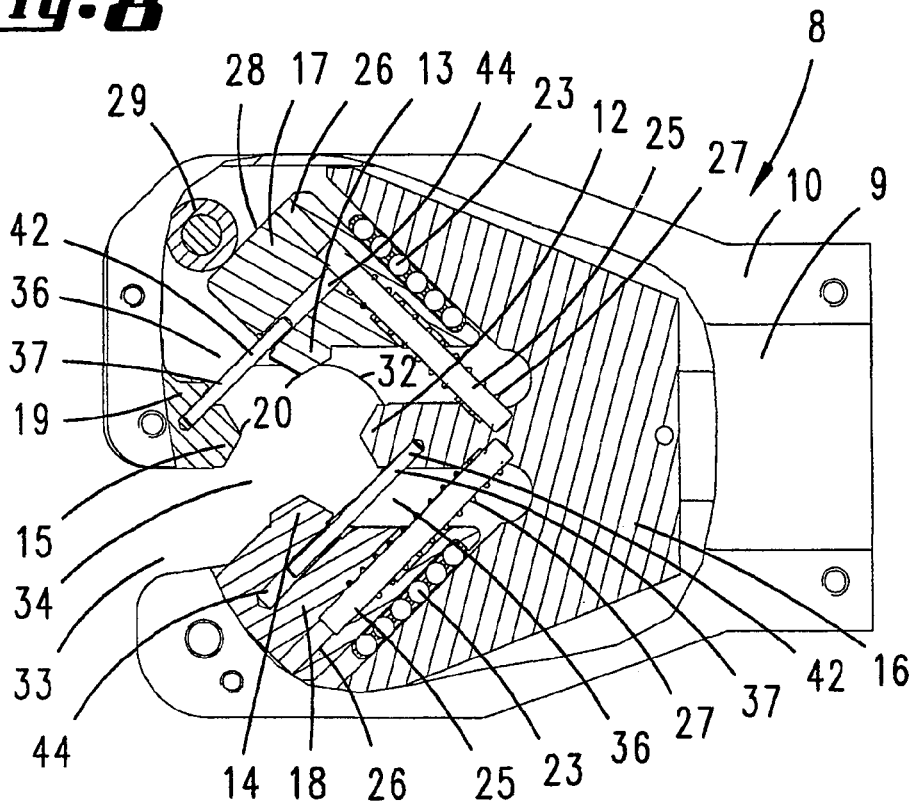
FIG. 8 shows an illustration corresponding to FIG. 3, but relating to a second embodiment of the pressing tool.
Figure 9:
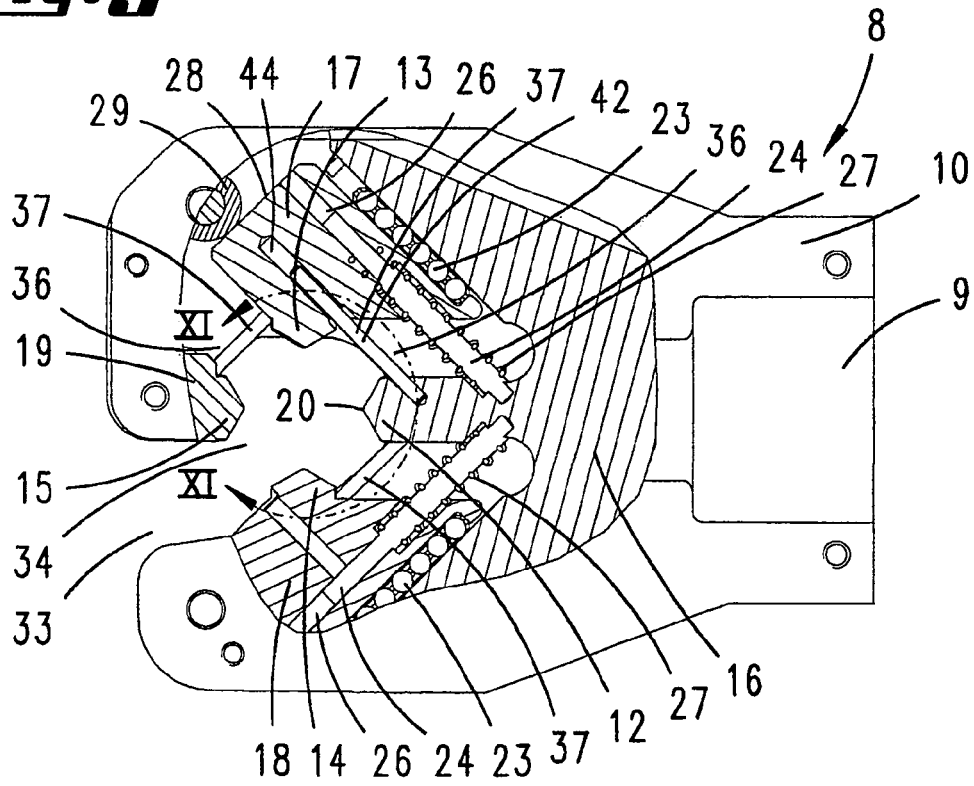
FIG. 9 shows a section through a plane adjacent to FIG. 8.

The edge 39 of the integrally formed extension element 37, this edge being directed towards the pressing space 34, runs approximately parallel to the remote roof edge 38 of the associated pressing mandrel, this edge 39 furthermore running into the eaves 41 of the roof of the facing roof edge 38 of the pressing mandrel (see FIG. 6).

The extension elements 37, which overlap when the pressing mandrels are moved together, close the clearance space 36, which is formed between the pressing mandrels, to the extent where the conventional-diameter blank cannot pass between the extension elements 37 into the clearance space 36. The extent a of the integrally formed extension element 37 is thus selected to be less than half the width b of the pressing-mandrel roof.

Figure 14:
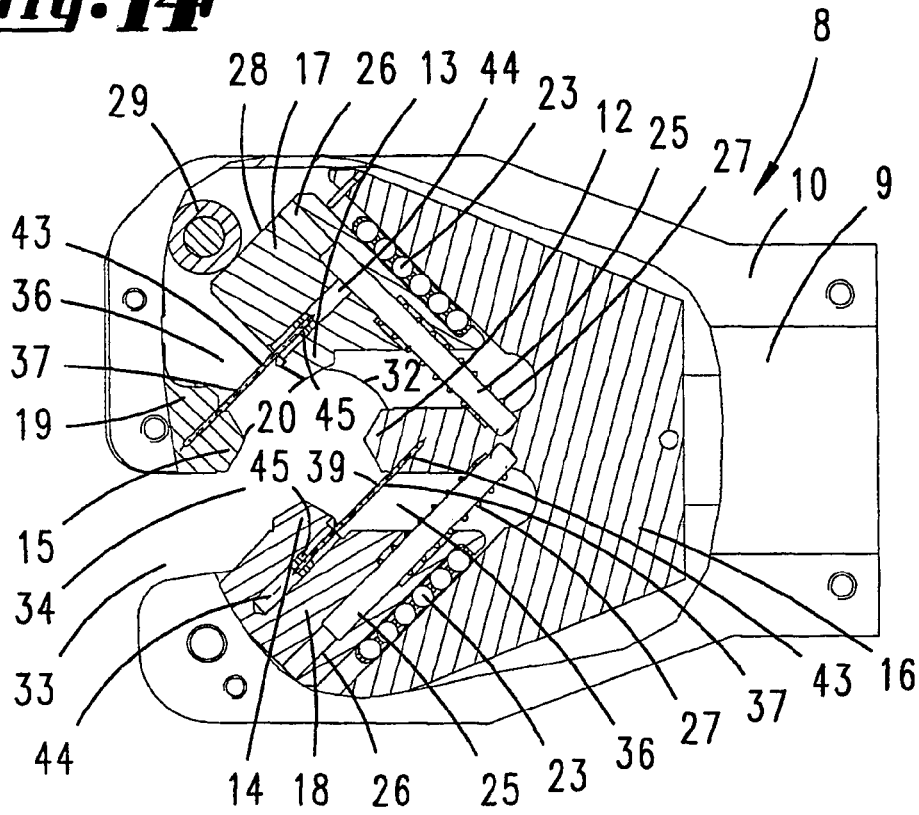
FIG. 14 shows the pressing tool in partially longitudinally sectioned illustration, relating to a third embodiment.
Figure 15:
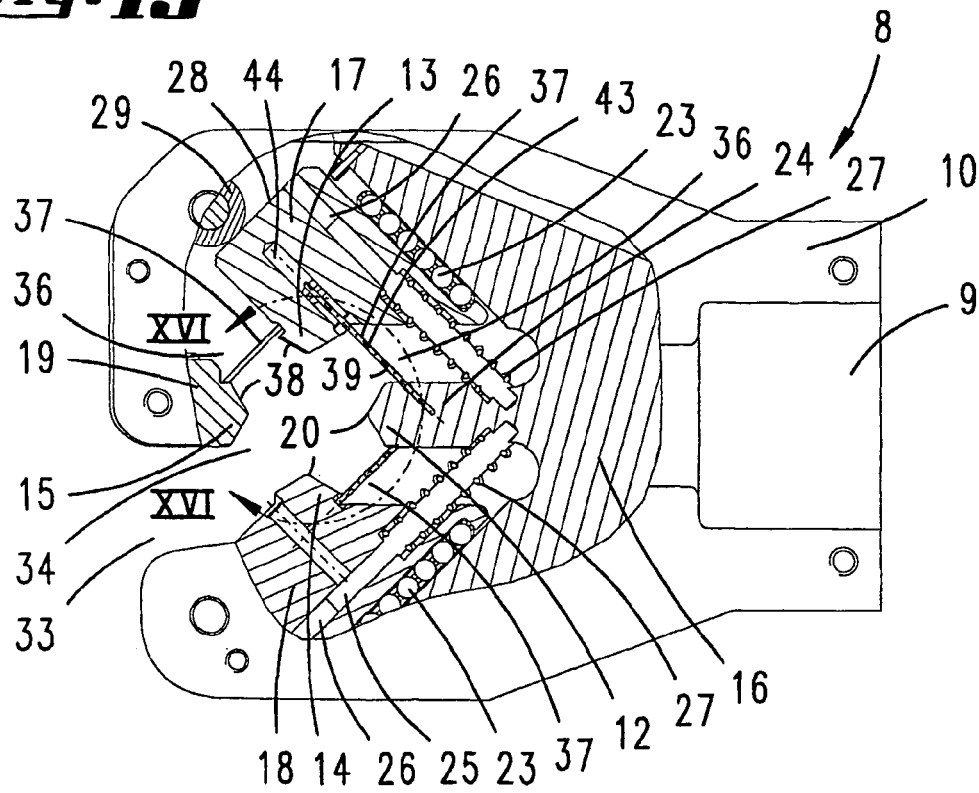
FIG. 15 shows the longitudinal section adjacent to FIG. 14.
Figure 16:
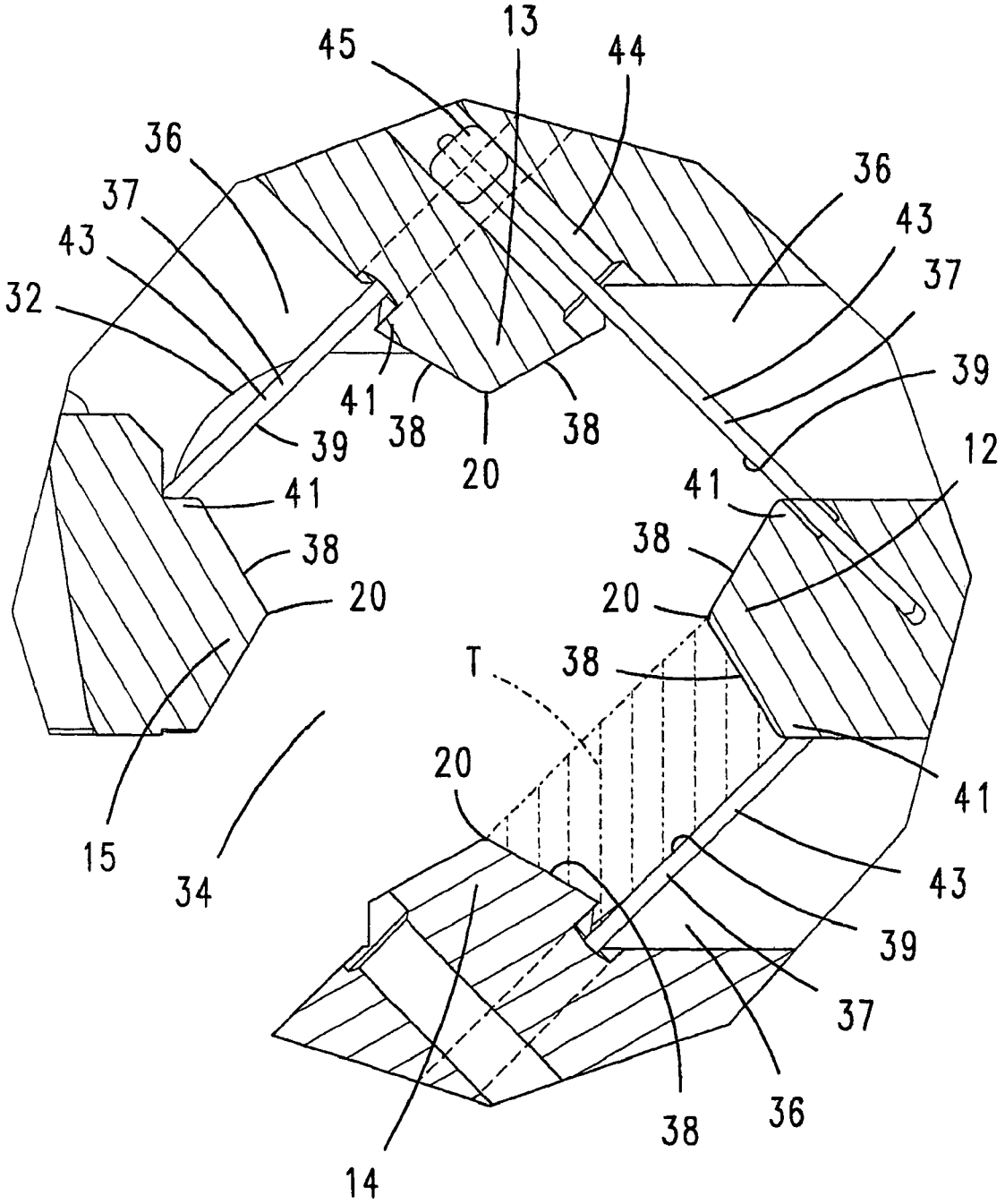
FIG. 16 shows the enlargement of the region XVI—XVI in FIG. 15.
Figure 18:
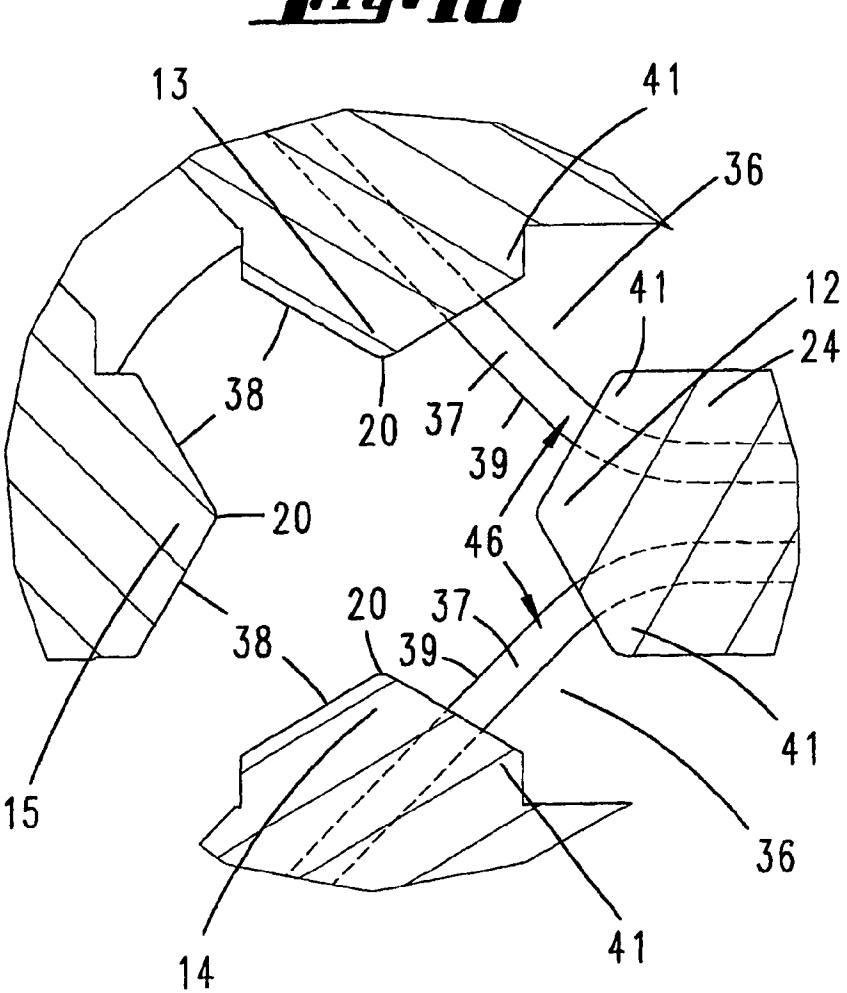
FIG. 18 shows the enlargement of the region XVIII—XVIII in FIG. 17.

As an alternative, the extension element 37 may be formed in a rod-like manner as a round rod 42 (see second embodiment in FIGS. 8 to 13) or as a needle 43 (see third embodiment in FIGS. 14 to 16). These rod-like extension elements 37—round rod 42 or needle 43—are anchored in one of the pressing mandrels and accommodated in a freely movable manner in the other associated pressing mandrel.

It is thus the case in the third and fourth exemplary embodiments illustrated that two rod-like extension elements 37 projecting in opposite directions are anchored in the continuation 24, which carries the pressing mandrel 12. These extension elements each pass through the adjacent clearance space 36 and penetrate into correspondingly formed guide bores 44 of the pressing jaws 17 and 18, which carry the pressing mandrels 13 and 14, respectively. Here too, the extension elements 38 are offset depthwise in relation to one another, that is to say they are disposed in offset planes.

Furthermore, a rod-like extension element 37 is anchored in the fixed pressing jaw 19, which carries the pressing mandrel 15, this extension element likewise penetrating into a guide bore 44 of the pressing jaw 17, which carries the pressing mandrel 13, and blocks the adjacent clearance space 36 in the operation.

In the second embodiment illustrated according to FIGS. 8 to 13, the diameter of the guide bores 44 corresponds to the diameter of the round rod 42 forming the extension element 37. In contrast, in the third exemplary embodiment, which is illustrated in FIGS. 14 to 16, the diameter of the needle 43 forming the extension element 37 is considerably smaller than the diameter of the guide bore 44, for which purpose the needle 43 has a sliding head 45 arranged, for guidance purposes, in the region of the guide bore 44.

Disposing the rod-like extension elements 37 directly beneath the roof edges 38 results in the cable eye 35 which is to be pressed enclosing an angle alpha, between a perpendicular S to the advancement direction u of the cable eye 35 and a bearing point P on a roof edge 38, which is larger than the angle of friction, this achieving the desired advancement of the eccentrically positioned cable eye 35 between the pressing mandrels during pressing. An angle alpha of 15 degrees is provided in the exemplary embodiment illustrated (see FIG. 12).

Figure 17:
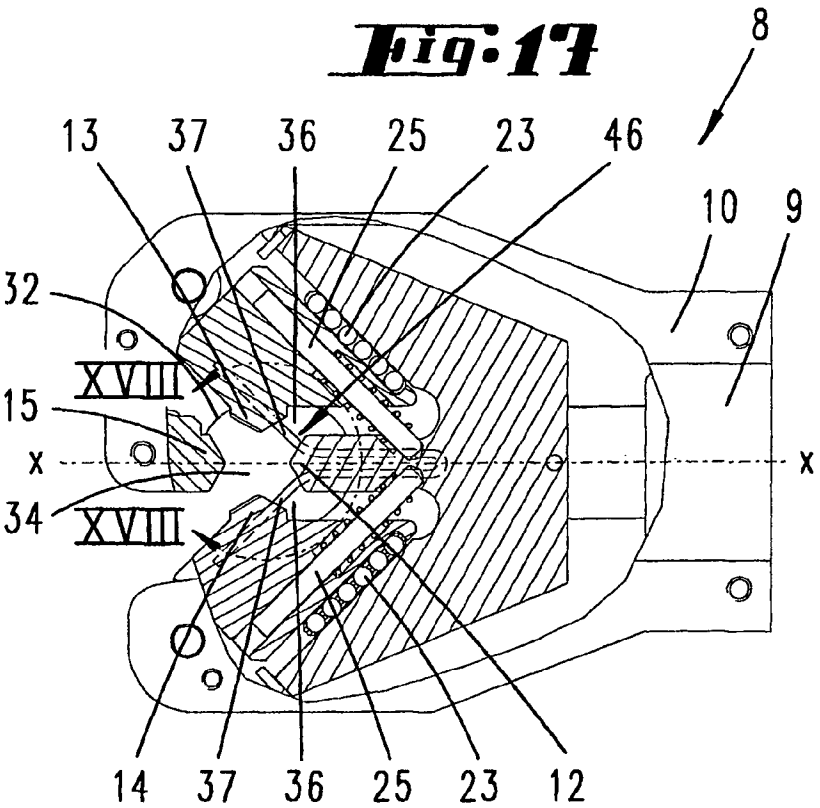
FIG. 17 shows a further illustration corresponding to FIG. 3, relating to a fourth embodiment of the pressing tool.
Figure 19:
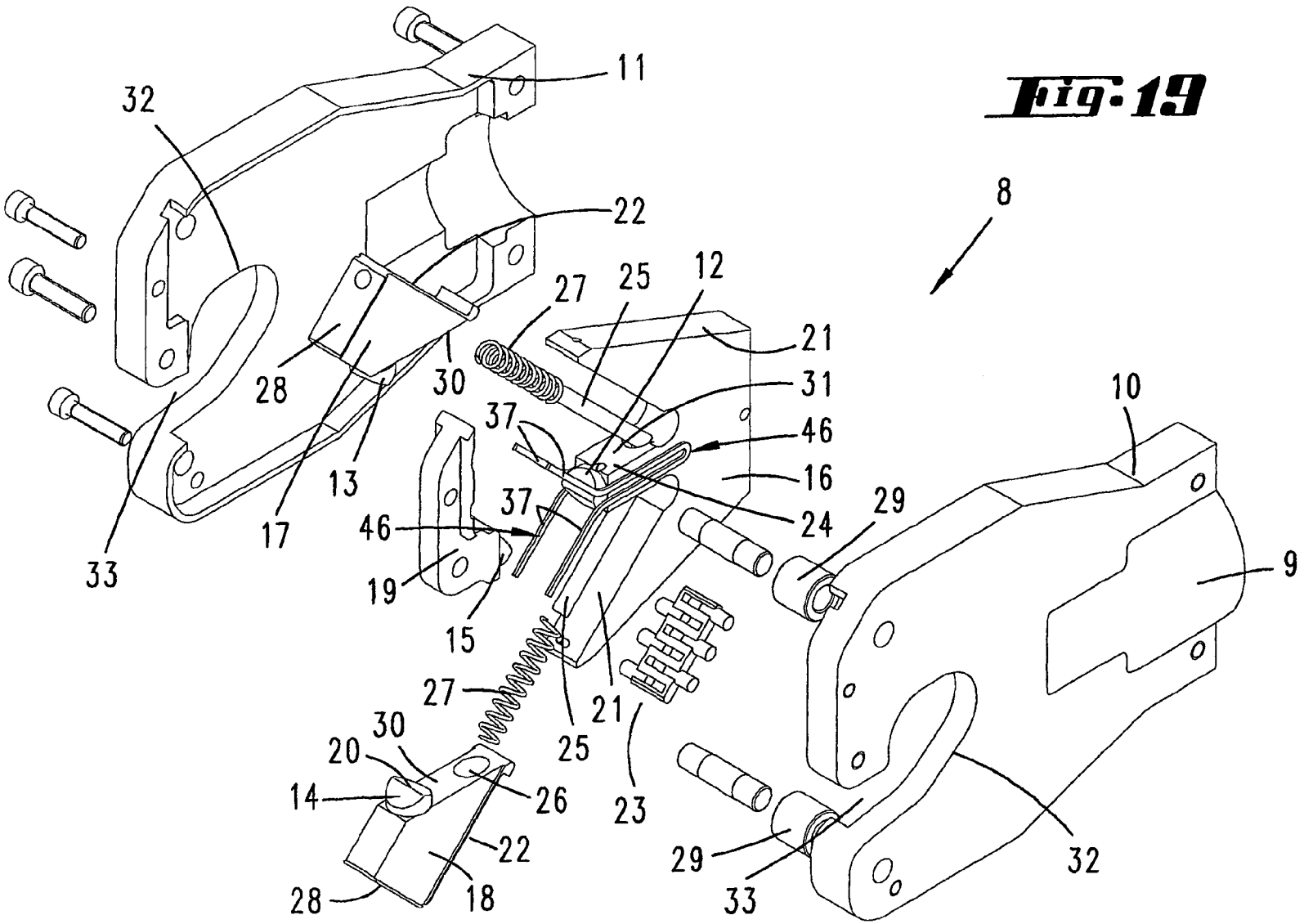
FIG. 19 shows a perspective exploded illustration of the pressing tool according to FIG. 17.
Figure 20:
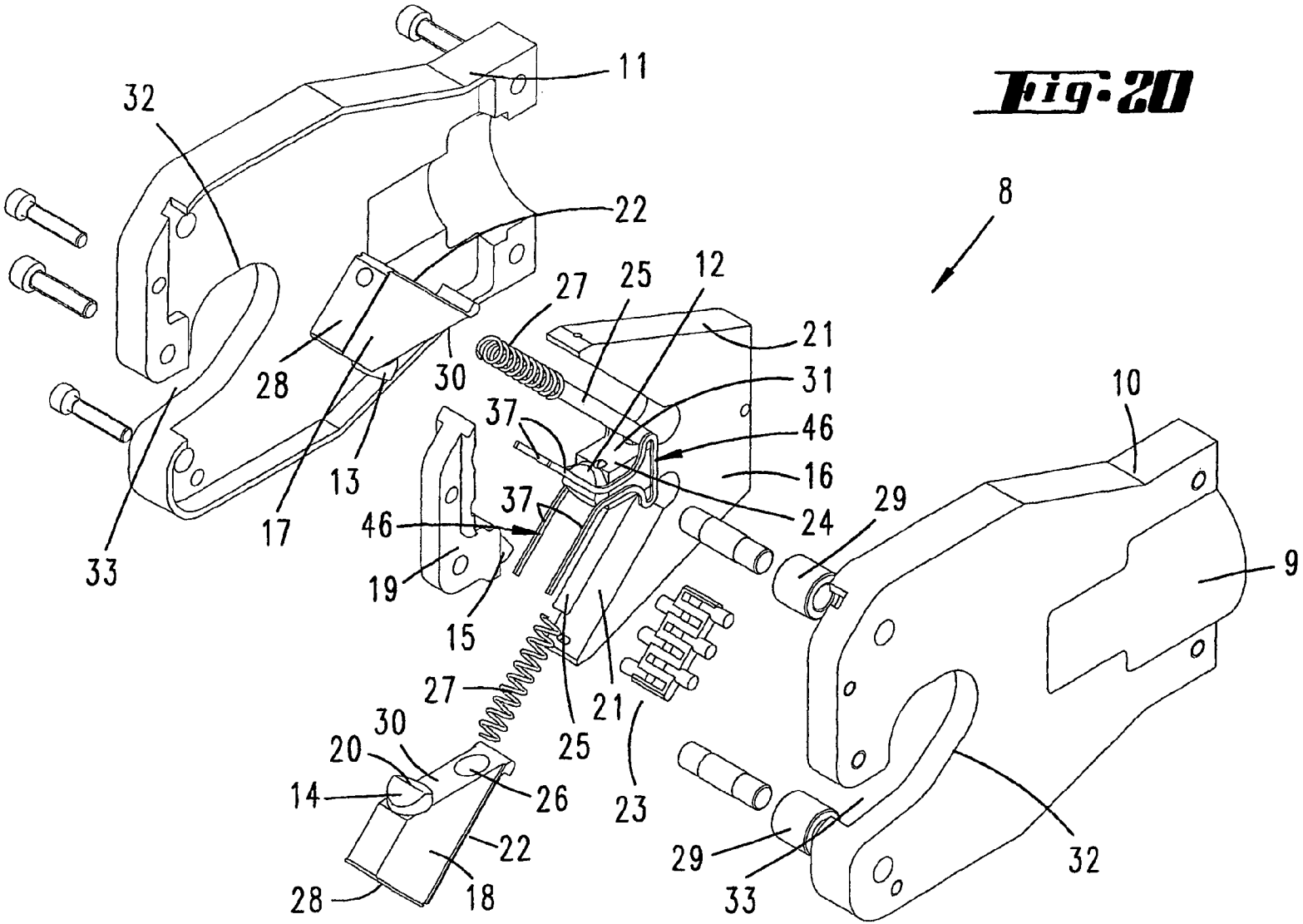
FIG. 20 shows a further perspective exploded illustration of a pressing tool in a fifth embodiment.
Figure 22:
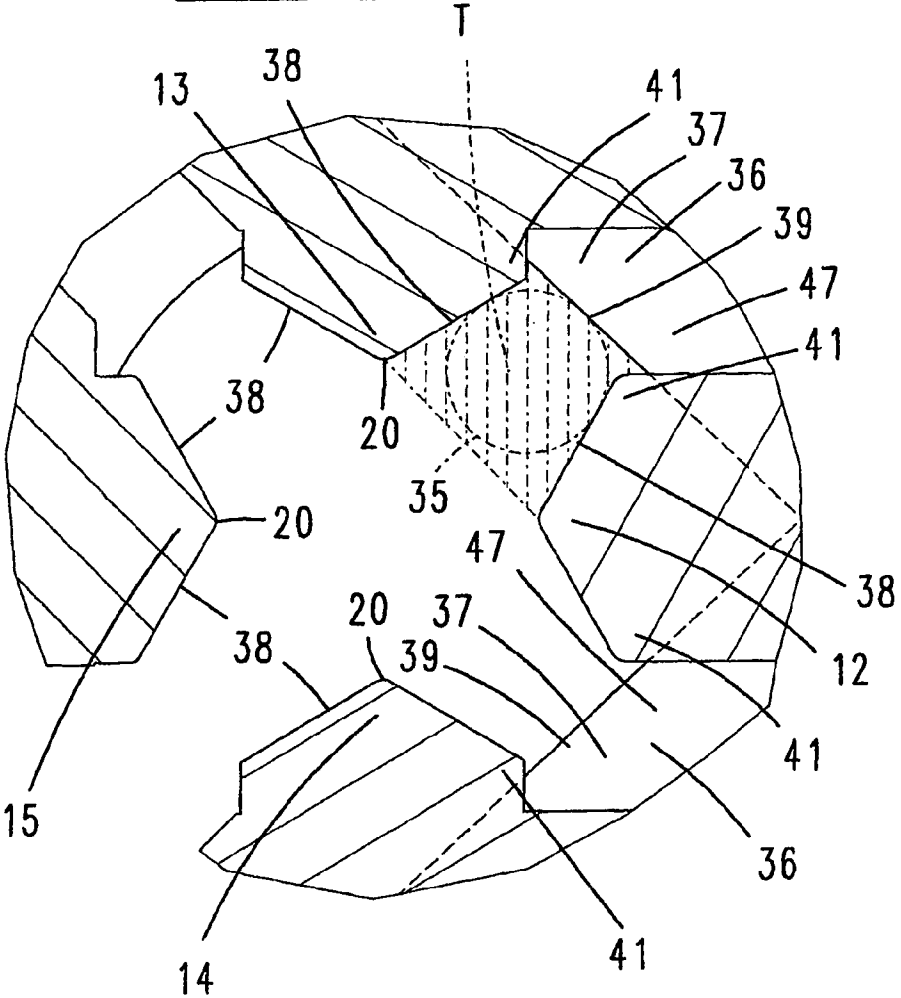
FIG. 22 shows the enlargement of the region XXII—XXII in FIG. 21.
Figure 21:
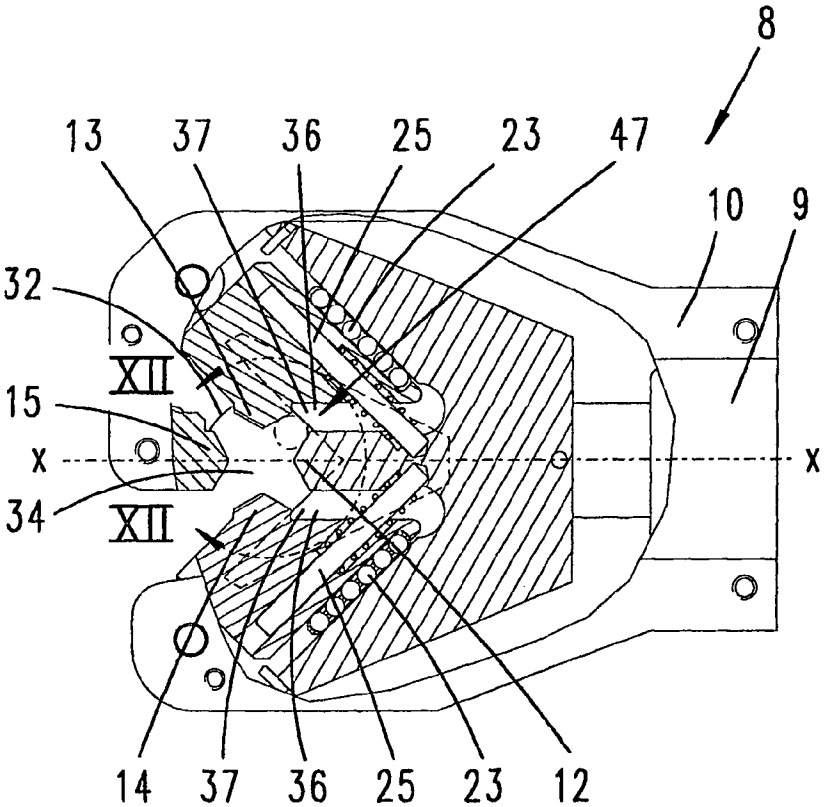
FIG. 21 shows a sectional illustration, corresponding to FIG. 3, of a pressing tool in a sixth embodiment.
Figure 23:
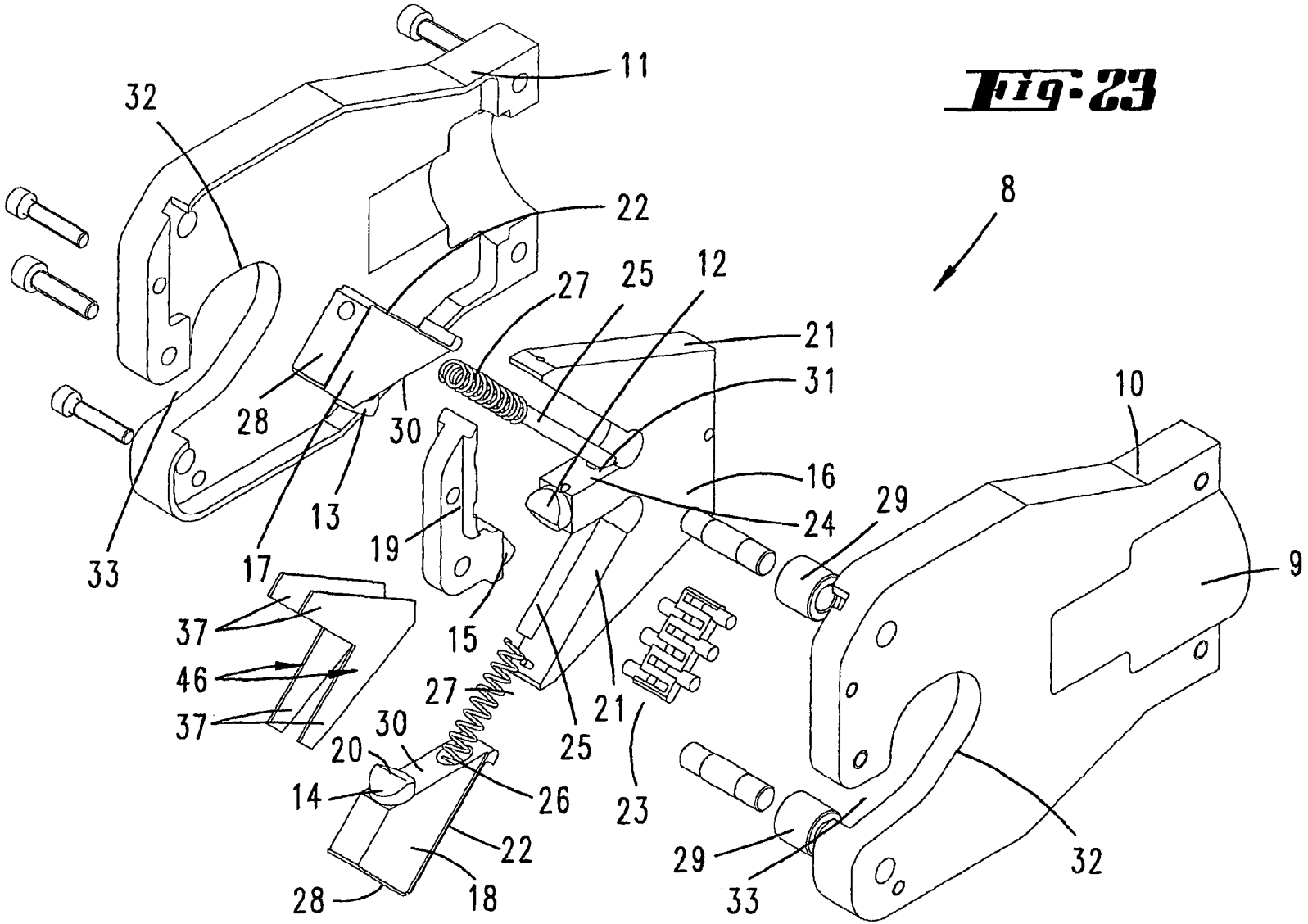
FIG. 23 shows the perspective exploded illustration of the pressing tool in FIG. 21.
Figure 24:
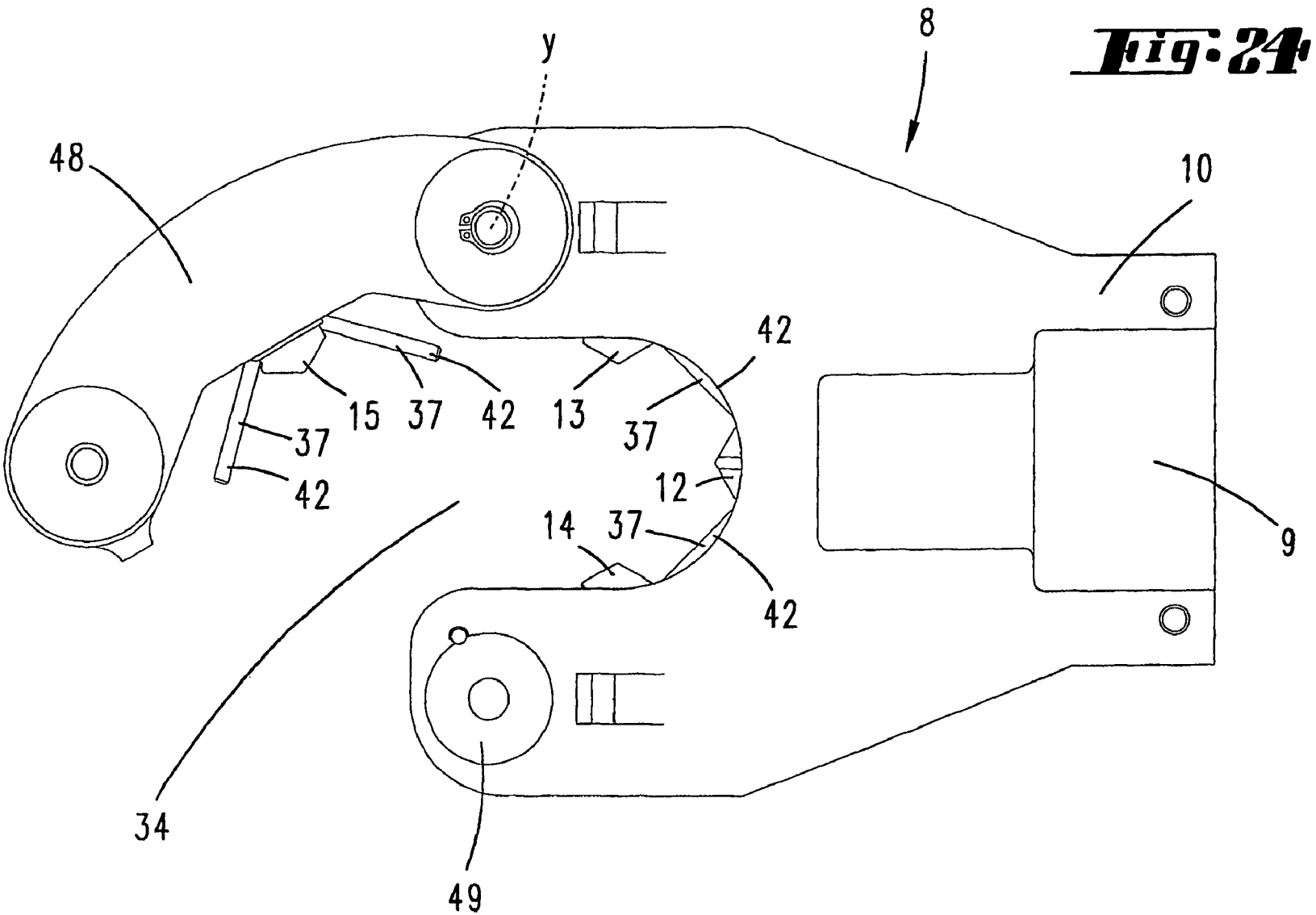
FIG. 24 shows a view of a pressing tool in a seventh embodiment, with a pivoting bracket retained in the open position.

As can further be gathered from the drawings of FIGS. 17 to 20, which illustrate a fourth and a fifth embodiment, the extension elements 37 may also be in the form of bent wire parts 46 which are disposed laterally opposite one another on the pressing mandrel 12 or pressing jaw 16 and the angled free legs of which block the clearance spaces 36 between the pressing mandrel 12 and the pressing mandrel 13 and between the pressing mandrel 12 and the pressing mandrel 14, as a result of which the blank is always forced into the correct pressing position by the wire legs. The sectional illustration in FIG. 17 shows an intermediate position during the pressing operation.

Furthermore, according to the sixth embodiment, the extension element 37 may be in the form of a sheet-metal angle element 47, these likewise being disposed opposite one another on both sides of the pressing mandrel 12 or of the pressing jaw 16 and, in the same way as the previously described bent wire parts 46, having symmetrically formed legs for forming the extension elements 37.

Finally, FIGS. 24 to 27 show a seventh embodiment, in the case of which the fixed pressing mandrel 15, and the pressing jaw 19 thereof, is fastened on a pivoting bracket 48, which is mounted in a pivotable manner on the housing and by means of which the radial access to the pressure space 34 can be blocked. For this purpose, the housing parts 10 and 11 have an approximately U-shaped outline in plan view, the U-opening forming the pressing space 34. The pivoting bracket 48 is mounted on one U-leg such that it can be rotated about an axis y. The other, free end of the pivoting bracket 48 can be latched in the region of the opposite U-leg of the housing, it being possible for this latching action to be cancelled by means of a handle 49 (not illustrated specifically).

Figure 25:
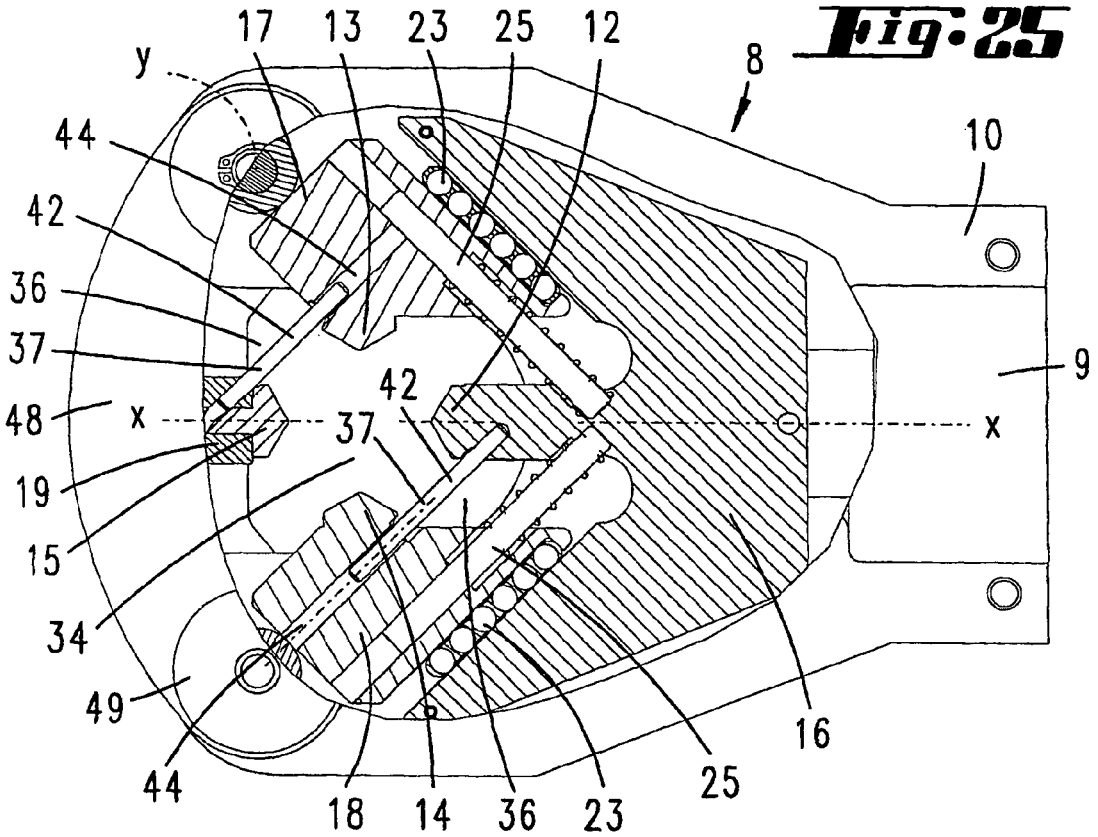
FIG. 25 shows a partial sectional illustration corresponding to FIG. 3, relating to the embodiment according to FIG. 24.
Figure 26:
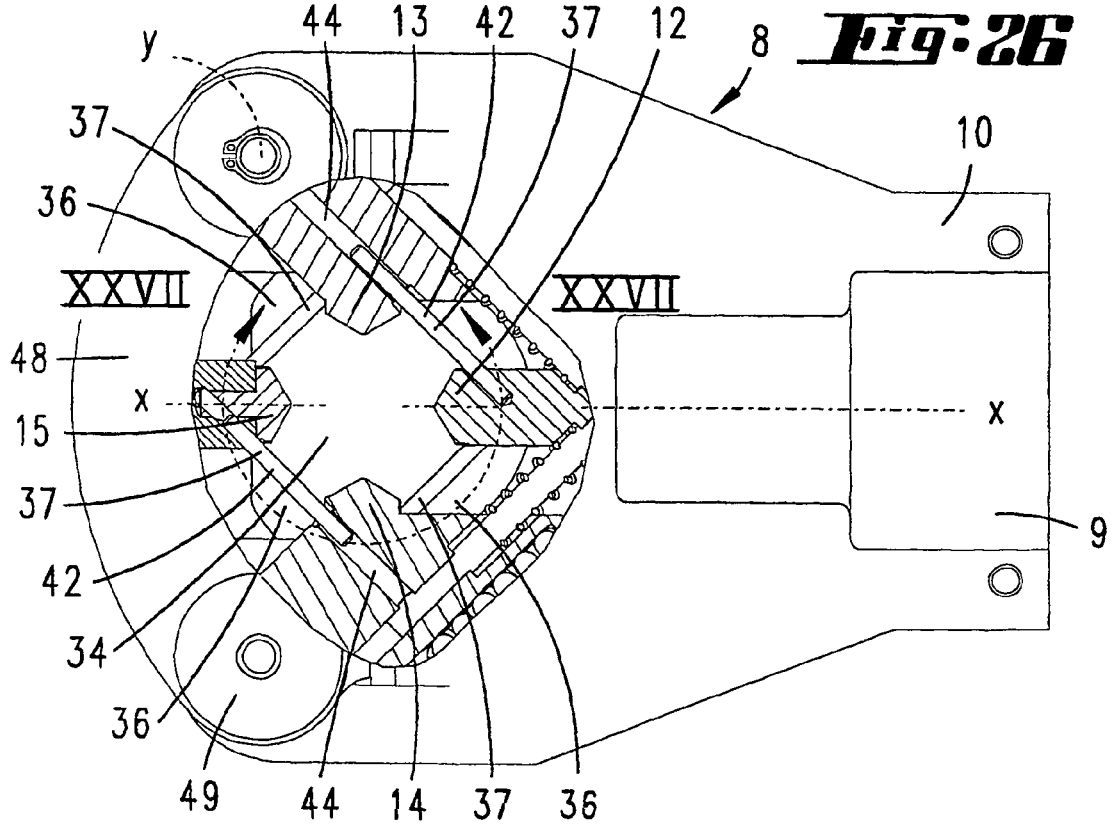
FIG. 26 shows a sectional illustration of the pressing tool, the section plane being offset in relation to that of FIG. 25.
Figure 27:
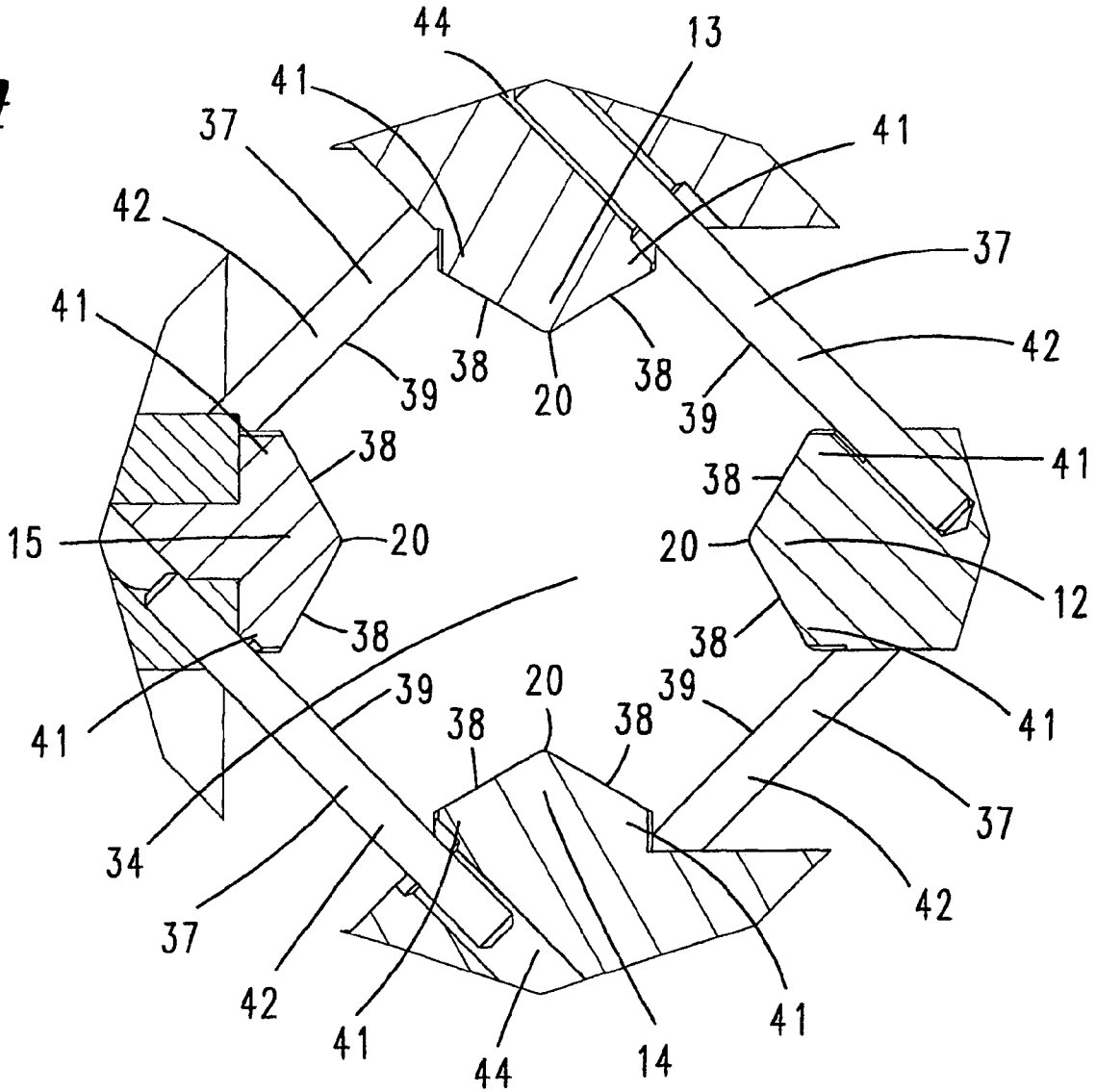
FIG. 27 shows the enlarged region XXVII—XXVII in FIG. 26.

Fitted on the fixed pressing mandrel 15, which is fastened on the pivoting bracket 48, are two extension elements 37 in the form of round rods 42, which project in opposite directions and, in the closed state of the pressing tool 8 according to FIGS. 25 and 26, penetrate into correspondingly associated guide bores 44 of the adjacent pressing mandrels 13, 14. The pressing space 34, which is fully enclosed by a pivoting bracket 48 being provided according to the invention, is surrounded, then, by four extension elements 37 which block all the clearance spaces 36 formed between the pressing mandrels.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

What is claimed is:

1. A pressing tool with three or four pressing mandrels for pressing a workpiece which can be moved towards one another during a pressing operation, each pressing mandrel having a roof-like cross-sectional profile which defines first and second roof edges which meet at a roof ridge, said first roof edges of each said pressing mandrel generally face said second roof edges of an adjacent pressing mandrel, and thus, furthermore, a lateral clearance space between the pressing mandrels is increasingly reduced during a pressing process, and disposed between two pressing mandrels is an extension element for engaging a workpiece which extends from one pressing mandrel to the other and moves into the other pressing mandrel during pressing, wherein the extension element, for the purpose of blocking the clearance space, is disposed such that, in the initial state and during pressing, the respectively facing first and second roof edges of the two pressing mandrels having the extension element disposed therebetween, cut across the extension element.

2. A pressing tool according to claim 1, wherein one pressing mandrel is fixed and the three further pressing mandrels can be displaced in the direction of a center of a pressing space during a pressing operation, wherein the fixed pressing mandrel is fastened on a pivoting bracket, by means of which radial access to the pressing space can be blocked.

3. A pressing tool according to claim 2 wherein two extension elements projecting in opposite directions are fitted on the fixed pressing mandrel.

4. A pressing tool according to claim 2, wherein an edge of the extension element which is directed towards the pressing space, runs directly beneath the respectively facing first and second roof edges of the two pressing mandrels having the extension element disposed therebetween.

5. A pressing tool according to claim 1, wherein an extension element is formed integrally with one pressing mandrel and moves into a corresponding recess of the other pressing mandrel.

6. A pressing tool according to claim 5, wherein said first and second roof edges of each said pressing mandrel define eaves opposite said roof ridge, and wherein an edge of the extension element which is directed towards the pressing space runs into the eaves of one of the first and second roof edges.

7. A pressing tool according to claim 6, wherein an extent of the integrally formed extension element is less than a width of the first and second roof edges, said width of the first and second roof edges being defined as a distance from the eaves of the first roof edge to the eaves of the second roof edge.

8. A pressing tool according to claim 6, wherein an extent of the integrally formed extension element is less than half a width of the first and second roof edges, said width of the first and second roof edges being defined as a distance from the eaves of the first roof edge to the eaves of the second roof edge.

9. A pressing tool according to claim 1, wherein two adjacent pressing mandrels each have an extension element formed thereon, the extension elements alternately projecting towards one another.

10. A pressing tool according to claim 9, wherein the extension elements are offset depthwise in relation to one another.

11. A pressing tool according to claim 1, wherein the extension element is formed by a rod-like element which is anchored in one pressing mandrel and is accommodated in a freely movable manner in the other pressing mandrel.

12. A pressing tool according to claim 1, wherein the extension element is a round rod.

13. A pressing tool according to claim 1, further including two rod-like extension elements offset in relation to one another.

14. A pressing tool according to claim 1, wherein the extension element is attached to a side surface of one of the pressing mandrels and moves past a side surface of one of the adjacent pressing mandrels during pressing.

15. A pressing tool according to claim 1, further including two oppositely located extension elements fastened on one of said pressing mandrels.

16. A pressing tool according to claim 1, wherein the extension element is in the form of a sheet-metal angle element.

17. A pressing tool according to claim 1, wherein the extension element is in the form of a bent wire part.

* * * * *